US005295284A

United States Patent [19]

Demuth et al.

[11] Patent Number: 5,295,284

[45] Date of Patent: Mar. 22, 1994

[54] ULTRA-HIGH PERFORMANCE CARDING MACHINE

[75] Inventors: Robert Demuth, Nurensdorf; Paul Staheli, Wilen b. Wil; Kurt Weber, Elgg; Peter Fritzsche, Winterthur, all of Switzerland

[73] Assignee: Maschinenfabrik Rieter AG, Winterthur, Switzerland

[21] Appl. No.: 669,953

[22] Filed: Mar. 15, 1991

[30] Foreign Application Priority Data

Mar. 16, 1990 [CH] Switzerland ..... 00877/90

[51] Int. Cl.[5] ..... D01G 15/02

[52] U.S. Cl. ..... 19/102; 19/112

[58] Field of Search ..... 19/98, 99, 102, 105, 19/106 R, 112

[56] References Cited

U.S. PATENT DOCUMENTS

| | | | |
|---|---|---|---|
| 3,685,100 | 8/1972 | Brown et al. | 19/98 |
| 3,730,802 | 5/1973 | Stewart et al. . | |
| 3,790,990 | 2/1974 | Goldman | 19/99 |
| 4,162,559 | 7/1979 | Stewart . | |
| 4,352,223 | 10/1982 | Graf Felix et al. | 19/106 R |
| 4,493,132 | 1/1985 | Dragagna et al. | 19/106 R |
| 4,813,104 | 3/1989 | Hollingsworth et al. . | |
| 4,831,691 | 5/1989 | Hollingsworth et al. | 19/106 R |
| 4,928,353 | 5/1990 | Demuth et al. | 19/105 |
| 4,970,759 | 11/1990 | Roberson | 19/105 |

FOREIGN PATENT DOCUMENTS

| | | |
|---|---|---|
| 0214438 | 3/1987 | European Pat. Off. . |
| 0252018 | 1/1988 | European Pat. Off. . |
| 0314310 | 5/1989 | European Pat. Off. . |
| 2050643 | 4/1971 | Fed. Rep. of Germany . |
| 1243034 | 8/1959 | France . |
| 1459952 | 11/1966 | France . |
| 2398126 | 2/1979 | France . |
| 549649 | 5/1974 | Switzerland . |
| 550866 | 6/1974 | Switzerland . |
| 739311 | 10/1955 | United Kingdom . |
| 862026 | 3/1961 | United Kingdom . |
| 2011966 | 7/1979 | United Kingdom . |

OTHER PUBLICATIONS

"Benefits for the Cotton System from the Use of Fixed Carding Flats", by K. Grimshaw, *Sammulung der Vortrage beim UMIST Kolloguim,* Jun. 26, 1984, pp. 166–180.

"Aufweitung von bewickelten Kardentrommeln durch Rotation", by Martina Haase and Klaus Butter, *Textiltechnik,* vol. 1, 1988, pp. 14–16.

"Technical Innovations in Carding Machines", by J. M. J. Varga, *Textile Month,* Dec. 1984, pp. 296–38.

*International Textile Bulletin,* 3rd Quarter 1988, table containing a comparison of features of present day cards in use, pp. 40–42.

"Observations for Improving Cotton Carding", by J. Simpson, *Textile Research Journal,* Jan. 1968, pp. 103–104.

"Metallic Card Clothing-Some Basics", by Deith Grimshaw, *Textile Industries,* Sep. 1976, pp. 109–113.

"Herstellung, Einsatz und Anwedung von Ganzstahlgarnituren" by A. Weber, *mittex,* Dec. 1988, pp. 545–547.

DIN Standard No. 64,123, "Sagezahndraht fur Ganzstahlgarnituren", and ISO Standards Hangbook No. 14, 1983, "Textile Machinery", pp. 296–311.

"A Quantitative Analysis of the Carding Action by the Flats and the Doffer in a Revolving-Flat Card", by A. Singh and N. B. Swani, *Journal of the Textile Industry,* 1973, pp. 115–123.

"Mechanismen des Faserdurchgangs in der modernen Kurzfaserkarde", by Prof. P. Viallier and Dr. J. Y. Drean, *textil praxis internatinal,* Oct. 1989, pp. 1063–1067.

Booklet 2 ("A Practical Guide to Opening and Carding") of the handbook series Manual of Textile Technology, by W. Klein, published by the Textile Institute, London, pp. 34–57.

*Primary Examiner*—Clifford D. Crowder
*Assistant Examiner*—Michael A. Neas
*Attorney, Agent, or Firm*—Sandler, Greenblum & Bernstein

[57] ABSTRACT

The working width of a carding machine for short staple fiber carding is reduced. As a result, the precision of the working elements and the complete arrangement is increased. The productivity of the carding machine is thus also increased.

13 Claims, 15 Drawing Sheets

Fig. 2
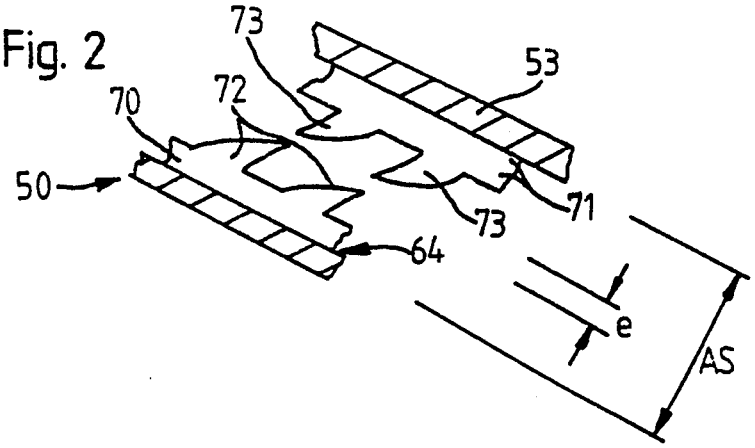
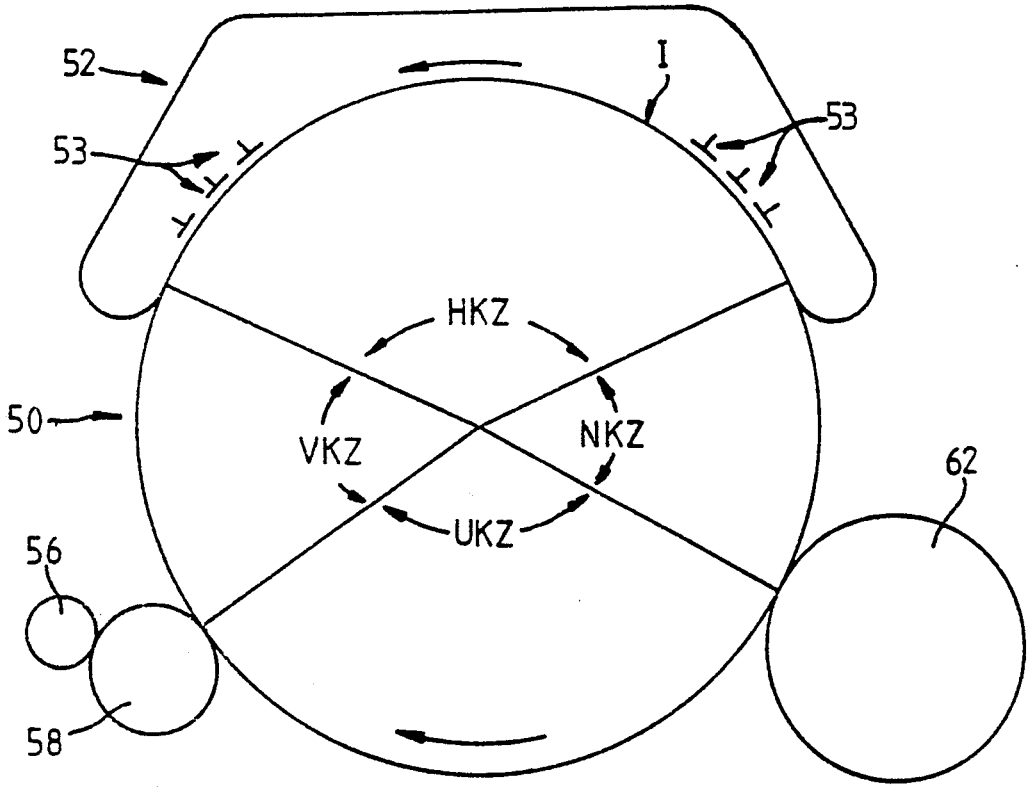
Fig. 1

Fig. 20
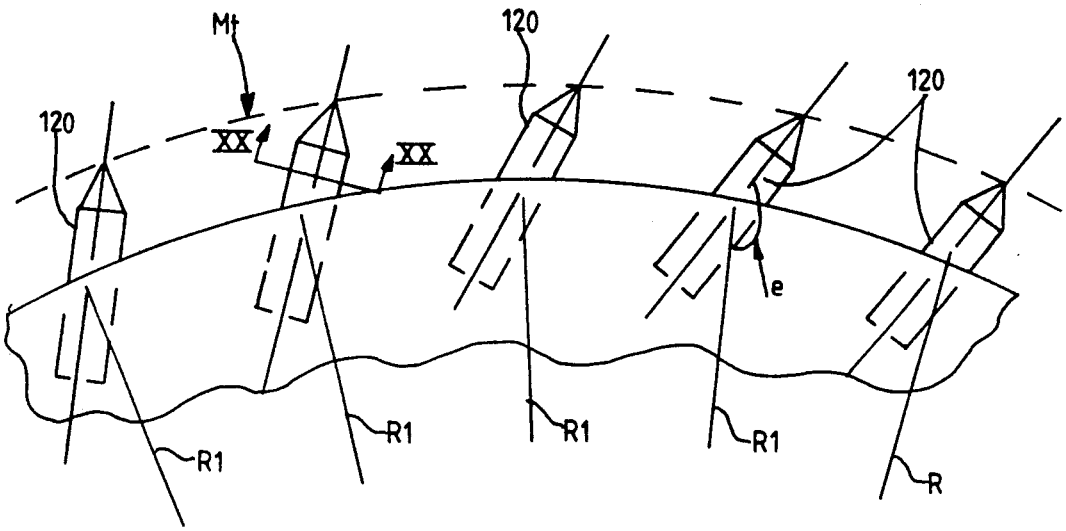
Fig. 22
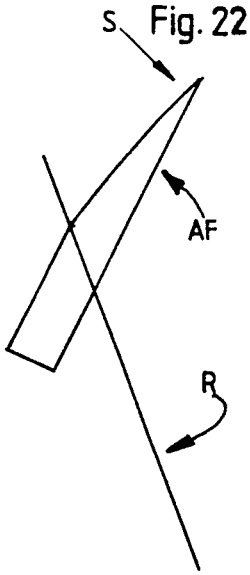
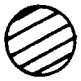
Fig. 20A
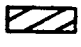
Fig. 20B
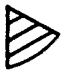
Fig. 20C

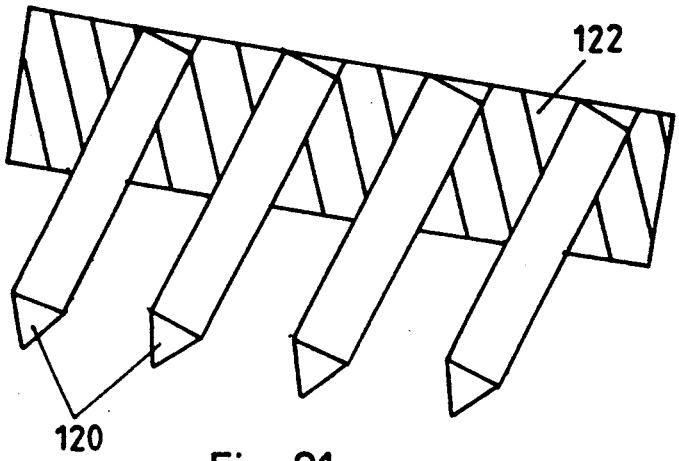
Fig. 21
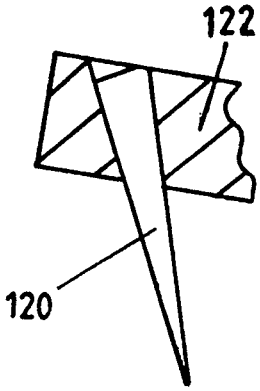
Fig. 21a
Fig. 23
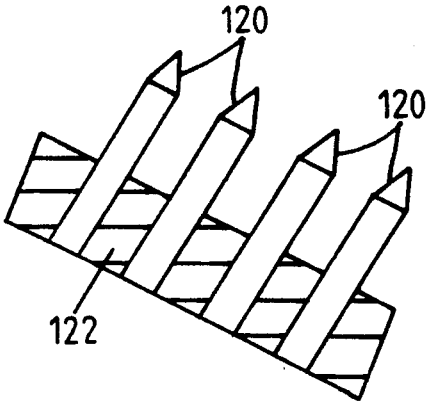

ULTRA-HIGH PERFORMANCE CARDING MACHINE

BACKGROUND OF THE INVENTION

1. Field of the Invention

The present invention relates to the carding of textile fibers, in particular short staple fibers with a maximum length of about 60 mm., and is concerned with the task of providing a new and improved construction of an ultra-high performance carding machine or card in order to render possible a high performance carding method.

2. Discussion of the Background and Material Information

The modern card comprises a so-called carding cylinder or two carding cylinders of larger dimensions. Each of these carding cylinders operate in conjunction with a flat, in order to carry out the actual carding work or operation. In order to render possible the flow of the fiber material, the carding cylinder, or the pair of carding cylinders, operate together with a feeding system (feed roller and licker-in or licker-in roller) and a doffing system. The feeding system normally processes fibers in the form of a fiber bat or wadding. The doffing system is normally layed-out for the formation of a sliver. Each working or operating element (carding cylinder, licker-in, doffer, flat) is provided with so-called card clothing which undertakes the actual processing of the fibers. A working or operating gap is located between the carding cylinder and its clothing (the clothing may be in the form of a working element or an element with a covering function).

The feeding system is to be designed for feeding the carding cylinder as uniformly as possible with the fibers to be processed which are distributed over the entire working width of the working element, that is, over the entire working width provided with clothing for processing of the fibers. The doffing system is layed-out over this entire width for the collection of the fibers to be processed in as uniform manner as possible.

The carding cylinder constitutes the heart or core of the carding machine and exerts a substantial influence upon all the functions.

REFERENCES

The following description refers at different locations to the following references:

Reference 1: Article entitled: "A Quantitative Analysis of the Carding Action by the Flats and the Doffer in a Revolving Flat Card", by A. Singh and N. M. Swami in the "Journal of the Textile Industry" 1973, pages 115 to 123.

Reference 2: Article entitled: "Mechanismen des Faserdurchgangs in der modernen Kurzfaserkarde"—translated as "Mechanisms of the Fiber Passage in the modern Short-Fiber Card", by Prof. P. Viallier and Dr. J. Y. Drean in "textil praxis international"—translated as "Textile Practice International" dated October, 1989, pages 1063 to 1067.

Reference 3: Booklet 2 ("A Practical Guide to Opening and Carding") of the handbook series "Manual of Textile Technology" published by the Textile Institute, London, Author: W. Klein, in particular, pages 35 to 37.

Reference 4: The book "High Speed Carding and Continuous Card Feeding" by Zoltan S. Szaloki, in particular, pages 3 to 87, from The Institute Series in Textile Processing, Vol. II., publisher: Institute of Textile Technology, Charlottesville, Va., USA.

Reference 5: Article "Metallic Card Clothing—Some Basics" by Keith Grimshaw, in "Textile Industries", dated September, 1976, pages 109 to 113 and/or "Herstellung, Einsatz und Anwendung von Ganzstahlgarnituren"—translated as "Manufacture, use and application of all-steel clothing" by A. Weber in "mittex" dated December, 1988.

Reference 6: DIN Standard No. 64,123 "Sägezahndraht für Ganzstahlgarnituren"—translated as "Saw tooth wire for all-steel clothing) and ISO Standards Handbook No. 14 (1983), "Textile Machinery" pages 296 to 311.

Reference 7: Article "Technical Innovations in Carding Machines" by J. M. J. Varga in "Textile Month", dated December, 1984, pages 31 to 38.

Reference 8: Patents of John D. Hollingsworth on Wheels Inc, relating to a compact carding machine—European Patent No. 14,310, U.S. Pat. No. 4,813,104 and their equivalents.

Reference 9: European Patent No. 252,018

Reference 10: Patents of W. & R. Stewart and Sons relating to needle clothing—British Patent No. 739,311; British Patent No. 862,026; German Patent No. 2,011,373 (cognate with U.S. Pat. No. 3,730,802); British Patent No. 2,011,966; U.S. Pat. No. 4,162,559 as well as German Patent Publication No. 2,050,643 of James Mackie and Sons Ltd.

Reference 11: A table containing a comparison of features of present day cards in use—International Textile Bulletin, 3rd quarter 1988, pages 40 to 42.

Reference 12: Article entitled: "Observations for Improving Cotton Carding", by J. Simpson in "Textile Research Journal", dated January, 1968, pages 103/104.

Reference 13: Article entitled: "Benefits for the Cotton System from the Use of Fixed Carding Flats", by K. Grimshaw. "Sammulung der Vorträge beim UMIST Kolloquim"—translated as "Collected Lectures of the UMIST Colloqium", Jun. 26, 1984.

Reference 14: Article entitled: "Aufweitung von bewickelten Kardentrommeln durch Rotation"—translated as "Expansion of Wound-on Card Cylinders through Rotation", by Martina Haase and Klaus Butter in "Textiltechnik", Volume 1, 1988, pages 14 to 16.

The function of the card in the complete process for spinning of short staple textile fibers is known to those skilled in this art and easy to assimilate from the literature (for example, References 3 and 4). The same applies to the general construction and the general operating method of these machines.

The behavior of the fibers within the card is, however, not known in detail. The theory of the machine is therefore predicated upon the theory of probability (Reference 1 and Reference 2). Practice is largely based on empirical methods.

Theory and practice are in accord that the fiber loading per unit of working surface of the carding cylinder cannot exceed a certain limit, without accepting sacrifices in quality (Reference 12). In order to nonetheless increase production, there have heretofore been tried out four directions of development:

1. Increasing the working surface by increasing the working width beyond 1 meter (Reference 3, page 35 and Reference 4, page 72).

2. Increasing the conveying speed of the fibers through the machine by increasing the rotational speed of the working or operating elements. This technique has been rendered possible by virtue of improvements in the development of the card clothing (all-steel clothing) and has enjoyed considerable success over the last twenty years.

3. Doubling the number of carding cylinders (tandem—card)—see Reference 7—that is, increeasing the working surface of the entire machine.

4. Improvement of the utilization of the available working surface on the main surface through the provision of additional stationary carding elements (Reference 3, pages 42 and 46 and Reference 13).

Even so, it has always been evident that the operation of the card is dependent upon the accuracy of the components and their adjustment or settings. This knowledge has, however, heretofore not been elevated to the basic concept of a development direction.

A further increase in the diameter of the (single) carding cylinder has not been heretofore proposed—its size has remained constant for years (Reference 7, pages 35/36). Different attempts to reduce this diameter are known (Ref. 4, page 87) but have heretofore been unsuccessful in practice. It has recently been suggested that this diameter should be reduced, in order to make the tandem card more compact (Reference 8).

Development direction 1 has proved to be difficult, above all because of the lack of structural strength or rigidity and the dimensional accuracy of the working or operating elements (see Reference 9 and Reference 3). Development direction 3 leads to high investment costs, except when retro-fitting machines which have long been installed, also to high maintenance costs and complicated adjustments or settings. The limits of the development directions 2 and 4 can be distinguished by:

The number of elements which exert an influence constantly increases; with an alteration of the production conditions there are now available a multiplicity of setting possibilities, so that setting of the entire machine for the processing of a given raw material is complex and costly.

The fibers can only be processed through intervention in the fiber mass, which unavoidably leads to a certain (more or less acceptable) fiber detriment. The increase in the number of carding elements can lead to a better opening of the fibers, but, at the same time, brings about unacceptable damage to sensitive fiber material.

The last-mentioned problem can be counteracted with an adroit selection of the type of clothing in different zones of the card, but this leads to further complications in the setting of the complete machine.

The expenditure for maintenance and servicing of the machine also increases by virtue of the steady increase in the working elements or the types of clothing.

The continual increase in performance implies more work per unit of surface area, which brings with it an increased energy requirement with constant efficiency in the utilization of this energy, leading to increased amounts of waste heat; a cooling system is also necessary for the large types of cards in use.

The all-steel clothing requires expensive maintenance if the machine should deliver high quality products throughout the entirety of its service life (Reference 5).

The efficiency of the machine as a fiber processing machine has resulted in large amounts of waste which must be disposed of because of environmental considerations without interfering with the surroundings of the machine. The machine, with its complete encasing and its feeding and doffing systems, is slowly becoming a "place eater".

In order to counteract this last-mentioned problem, which occurs especially in connection with the so-called tandem card with its two carding cylinders, a so-called compact apparatus has been proposed, for example, in U.S. Pat. No. 4,813,104, wherein, the carding cylinders, in particular, are arranged vertically instead of horizontally and the diameters of the carding cylinders are reduced.

SUMMARY OF THE INVENTION

Therefore, with the foregoing in mind, it is a primary object of the present invention to provide a new and improved construction of carding machine or card which is not associated with the aforementioned shortcomings of the prior art.

Another and more specific object of the present invention aims at devising a ultra-high performance card machine by departing from prevailing considerations and embarking upon a new design of the carding machine.

THE INVENTION

The invention dealt with in this document emanates from the consideration that the basic process of carding can remain unaltered but, at the same time, a new development direction must be inaugurated in order to render possible further production and quality improvements without losing control of the carding process or placing it at risk.

This new development is founded on the knowledge that the technology of the carding method or process is decisively dependent upon the precision of the machine components and the relationship between the machine elements. In order to make further progress, the invention therefore strives for a considerable improvement in the precision or accuracy of the carding method or process. Accordingly, the invention contemplates a redesign of the carding machine or card with precision as the main or foremost objective of the new construction instead of merely as a subsidiary objective.

Now in order to implement the foregoing objects, and others which will become more readily apparent as the description proceeds, the invention contemplates, as a substantial step to the achievement of higher precision, a construction of carding machine or card which is manifested, among other things, by the features that the working width is reduced, and specifically such that the dimension thereof does not exceed 800 mm., for example, lies between 400 and 600 mm. and preferably beneath 400 mm.

The reduction of the working width leads directly to a lower bending or deflection of the working elements in a transverse direction with respect to the working width, because the working width of an element influences the bending or deflection to the third power. This working width reduction, at the same time, directly leads to an increased dimensional accuracy of the working or operating elements and also renders possible an improved mutual positional accuracy of the working elements in relation to each other.

All the parts or components influencing the working or operating gap (for example, the carding cylinder and the flat rods) are preferably produced from a material having a high modulus of elasticity in order to reduce the bending or deflection over the working width. For instance, steel or fiber reinforced plastic are suitable materials of this type. The material selected must render possible the desired dimensional accuracy of the part or component (with appropriate manufacturing methods) and such part or component must retain its shape in operation. The material should have a correspondingly low thermal expansion, so that any waste heat (which is unavoidable with high production) does not lead to disturbing deformations of the working or operating elements.

As a further preferred step, it is contemplated that the diameter of the carding cylinder (or its working surface) is reduced and, specifically, such that a dimension of 800 mm. is not exceeded, and preferably, such lies between 350 and 450 mm. Nevertheless, this carding cylinder preferably operates directly in conjunction with the feed and doffer systems, that is, the carding machine or card only contains one or a sole carding cylinder. The card is preferably a revolving flat card, that is, the carding cylinder operates together with a revolving flat arrangement.

Through the reduction of the working width, it is possible to ensure the desired mutual setting of the working or operating elements over this full working width. This is particularly important in connection with the revolving flat arrangement where the main carding work or operation is performed. The higher precision of the working elements, in other words, their arrangement, renders possible a more intensive treatment of the fibers (that is, a more dense occupation of the working surfaces by the working elements), resulting in a greater production notwithstanding the reduction in the total working surface.

According to the principle that the carding method or process can remain unaltered as concerns its fundamentals, the respective diameter of the licker-in and the doffer are reduced in accordance with the reduction of the diameter of the carding cylinder, for example, in order to maintain the present-day prevailing inter-relationships of these roll or cylinder diameters. It is then possible to mount at least the licker-in and the doffer, and preferably all the working elements, rotating and stationary, which form the working or operating gap in conjunction with the carding cylinder, upon two integral or one-piece, undivided side walls.

By virtue of the last-mentioned measure, it is ensured that upon assembly of the equipment, no surfaces which are to be brought into contact with one another between the bearings of the carding cylinder, licker-in and doffer, can influence the mutual setting or adjustment of these elements. Furthermore, there can be achieved the result that at each side wall the bearings or attachment locations of all the aforementioned elements can be formed in one clamping or chucking operation during the manufacturing process. If the side walls are not each formed in one piece or as integral structures, then the parts of the side walls should be rigidly interconnected at least before the formation of these bearing or mounting locations.

The side walls in connection with a base plate and a revolving flat frame preferably form a base frame of the machine. The mountings or supports of the stationary elements, for instance, carding plates and licker-in combs, can be utilized as an additional transverse reinforcement.

The smaller or more compact construction of the entire machine promotes simplified maintenance without substantial loss in production. It can be contemplated, for instance, that the individual machine (as a component of a machine group) can be replaced as a unit by a replacement machine in order to permit overhauling in a suitable repair shop (quick exchange). The maintenance can be still further simplified when, according to a preferred aspect of the invention, the machine is constructed from modules (for example, carding cylinder, individual rotating parts, revolving flat arrangement) in such a manner that each module can be separately dismantled from the frame without the necessity for dismantling the other modules.

In a preferred embodiment, the guides for the revolving flat in their working position in relation to the carding cylinder, are not formed directly on the side walls, rather are supported by the shaft of the carding cylinder, for instance according to a principle set forth in Reference 9.

The shaft of the carding cylinder is preferably mounted by play-free bearings (shoulder bearings) in the side walls. The shaft of the licker-in and the doffer also can be supported by play-free bearings (shoulder bearings); normally, it should be sufficient to provide grooved bearings for these elements.

When the carding cylinder is divided into four imaginary quadrants, the feeding and doffing zones are preferably provided in one quadrant.

The principles dealt with in this document are applicable to cards or carding machines working with a single carding cylinder or with two carding cylinders (tandem cards). Moreover, in the latter case, these principles render possible an even more compact construction than that already known from Reference 8. The present invention is, however, particularly suitable for use in a carding machine or card provided with only a single carding cylinder and is described in greater detail in connection with this type of carding machine.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic side view of a carding machine or card which could be constructed either according to this invention or in a conventional way; this figure serves principally for the identification of the essential working elements and working zones of the carding machine;

FIG. 2 is a schematic representation, to a much larger scale, of the mutually oppositely situated clothing elements of the carding machine according to FIG. 1;

FIG. 20 is a schematic representation of a new type of clothing for use with the carding cylinder of a short staple fiber carding machine or card;

FIGS. 20A, 20B and 20C each depict a variant of the cross-section of the clothing of FIG. 20 as viewed in the sectional plane XX—XX thereof.

FIG. 21 illustrates a first variant of the clothing of the flat rods or possible additional carding elements corresponding to the new carding cylinder clothing;

FIG. 21A illustrates a second variant of the clothing of the flat rods or the additional carding elements;

FIG. 22 illustrates a further variant of the needle shape for the new clothing; and FIG. 23 illustrates a carrier or support rod for the needles of the new type of clothing.

DETAILED DESCRIPTION OF THE PREFERRED EMBODIMENTS

Figure 4:
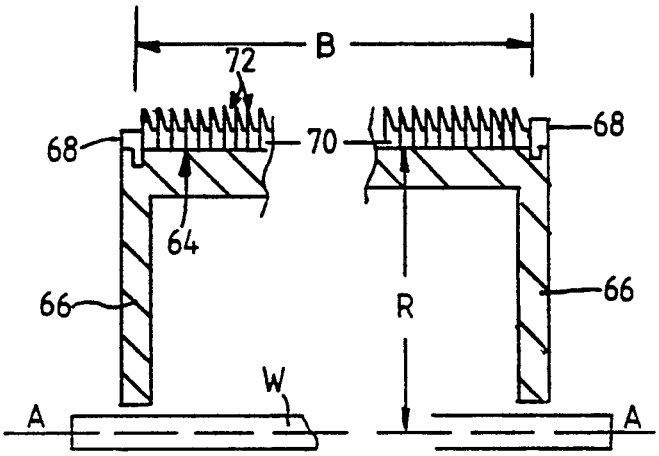
FIG. 4 is a schematic representation of a part of the carding cylinder of the carding machine depicted in FIG. 1 together with its wiring (clothing); this figure serves principally for the explanation of the term "working width" or "operating width"

Describing now the drawings, it is to be understood that only enough of the construction of the carding machine or card has been depicted therein, in order to simplify the illustration, as needed for those skilled in the art to readily understand the underlying principles and concepts of the present invention. FIG. 1 schematically shows the main working elements of a revolving flat carding machine or card. The carding machine contains one single or sole main cylinder 50 (the so-called carding cylinder), which is supported to rotate in a frame (not shown in FIG. 1). In FIG. 1 a clockwise rotation is assumed. The carding cylinder 50 operates together with three further essential working or operating elements, namely:

a revolving flat arrangement 52 (that is, it is not here a matter of a carding machine equipped with working rolls or rollers or only with stationary carding plates);

a fiber feeding system 54 (FIG. 3), which in particular contains a feed roller or roll 56 and a licker-in or licker-in roll or cylinder 58; and a fiber doffing system 60 (FIG. 3) which in particular contains a so-called doffing roll or cylinder 62 (or doffer).

The revolving flat arrangement 52 contains flat rods 53, only six of which are represented in FIG. 1. A revolving flat arrangement of present day conventional design contains more than one hundred flat rods 53. The flat rods 53 are carried at their ends by endless chains (not shown) and are thereby preferentially moved opposite to the direction of rotation of the carding cylinder 50 (according to the working principle of the C4-carding machine or card of the assignee).

FIG. 4 schematically shows part of the carding cylinder 50 with its cylindrical surface 64 and side shields or plates 66. The cylindrical surface 64 is provided with card clothing which, in this embodiment, is in the form of a wire or clothing wire 70 equipped with saw teeth 72. This type of clothing is widely known at the present time, and thus, need not be here further considered. Standards for such clothing have been set forth, as, for example, in Reference 6, and an explanation of this type of clothing can be found in Reference 3 and elsewhere. A good picture of a wired carding cylinder has been provided in Reference 2 (page 1064). The clothing practice for the United States has been explained in Reference 4.

FIG. 2 shows a detail on an enlarged scale, for example, at the location or position I of FIG. 1. The wire clothing 70 is again shown with two of its saw teeth 72. FIG. 2 also shows a part of a flat rod 53 which forms the operating gap AS in relation to the cylindrical surface 64. The flat rod 53 is also provided with clothing in the form of a length of wire or clothing wire 71 equipped with saw teeth 73. The carding operation or work is carried out between these two clothing elements or wires 70 and 71. This carding operation is substantially influenced by the position of one clothing in relation to the other as well by the clothing gap "e" between the tips of the teeth of both clothing elements or wires 70 and 71.

The part HKZ (FIG. 1) of the periphery of the carding cylinder 50, which is covered by the revolving flat arrangement 52, can be designated as the main carding zone. As recently as ten years ago, the complete carding work was carried out in this zone HKZ. In latter years, however, more and more additional working elements have been provided in other zones of the carding cylinder, in order to bring about a further intensification of the carding operation or work. The part VKZ of the periphery of the carding cylinder 50 between the licker-in 58 and the revolving flat arrangement 52 is here designated as the pre-carding zone, the part NKZ of the periphery of the carding cylinder 50 between the revolving flat arrangement 52 and the doffer 62 as the re-carding zone, and the part UKZ of the periphery of the carding cylinder 50 between the doffer 62 and the licker-in 58 as the under-carding zone.

Rod shaped elements 55 (FIG. 3) are often mounted at the present time in the pre-carding zone, the re-carding zone and the under-carding zone of the carding machines. As a result, there can be achieved different additional effects. It should be noted, however, that the mere increase in the number of such additional elements does not necessarily lead to better carding. One proposal (for example, according to German Patent Publication No. 2,033,036) uses almost the entire cylindrical surface of the carding cylinder, but does not lead to the desired objective. As soon as the fibers are arranged in the direction of rotation of the carding cylinder, then no clothing can achieve a further substantial effect (the clothing cannot exert any forces on the fibers). Rather, one should strive for a purposeful or directed use of additional carding elements.

Furthermore, each additional element must be set or adjusted exactly opposite the carding cylinder 50, in order to realize the contemplated effect. An increase in the number of carding elements results in a corresponding increase in the setting work or task and attendant setting complications. Furthermore, it must be possible to maintain all the settings.

The saw tooth wire 70 is drawn on to the carding cylinder 50, that is, this wire is wound into convolutions or coils lying close to each other between side walls 68 (FIG. 4), in order to form a cylindrical working surface 64 equipped with pointed teeth. The axial dimension B of this working surface 64 can be designated as the working width. The carding operation performed on the cylindrical working surface 64 should be carried out as uniformly as possible, that is, the fibers are processed at that location. The working width B of the carding cylinder 50 is consequently decisive for all the other working elements of the carding machine or card, in particular for:

the revolving flat or flat arrangement 52, which together with the carding cylinder 50, must card the fibers evenly or uniformly over the entire working width B, the feeding system 54, which must continually ensure an evenly distributed fiber flow on the carding cylinder 50 over the entire working width B, and the doffing system 60, which must continually lift off fibers from the carding cylinder 50 over the entire working width B.

In order to be able to perform work evenly or uniformly over the whole or entire working width B, the settings of the working elements (including possible additional elements) must be maintained over the entirety of this working width B. However, the carding cylinder 50 can be deformed or distorted due to the wrapping-on or winding of the clothing wire and/or the centrifugal force (Reference 14), wherefore additional rigidity can be acquired through additional material (wall thickness). The flat rods 53 are normally provided with reinforcing ribs, in order to reduce the deflection or sag as far as possible. Special measures for stiffening by additional elements (carding segments) can also be utilized (see, for example, the commonly assigned, U.S. patent application, Ser. No. 07/621,847, filed Dec. 4, 1990, and entitled "Main Cylinder Casing Segment", to which reference may be readily had and the disclosure of which is incorporated herein in its entirety b reference.

In FIG. 4, the shaft W of the carding cylinder 50 is also shown. This shaft W is carried in a frame or casing, which is not shown in FIG. 4, so that the carding cylinder 50 can be rotated by a suitable drive (not shown) about the longitudinal axis A—A of the shaft W. The diameter ($\phi$) of the cylindrical surface 64 (that is, twice the depicted radius R) is also an important dimension of the machine, as will be represented in the following in connection with further figures.

Figure 5:
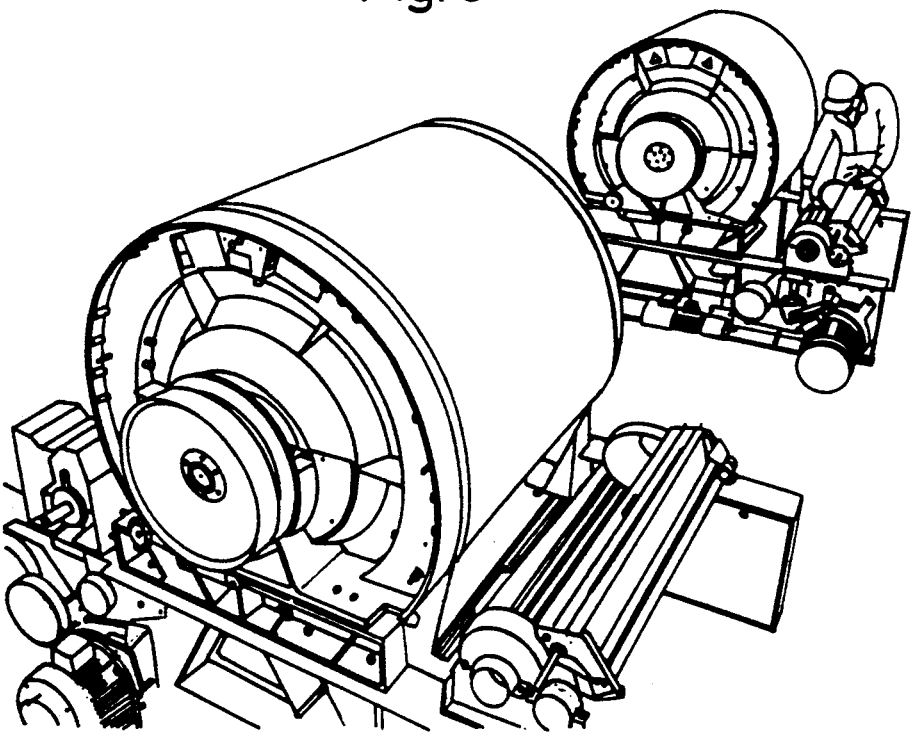
FIG. 5 is a photograph of a carding cylinder of a conventional carding machine or card constructed from cast-iron, and the picture of the person working on the carding machine should provide a criterion for the size of the cast-iron part.

The most conventional cards in service at the present time (Reference 11) have a working width in the order of 900 mm. to 1500 mm. with a carding cylinder diameter in the order of 1200 mm. to 1500 mm. The carding cylinder for such a carding machine is produced as a cast-iron component. The photograph in FIG. 5 depicts a carding cylinder for a carding machine with a working width B of 1000 mm. and a diameter of 1300 mm. and having a weight of 1000 kgs. The usual dimensions of carding cylinders of carding machines in use at the present time, as well as those for carding machine or cards with single of tandem carding cylinders, are set out in References 3, 4 and 7.

Figure 6:
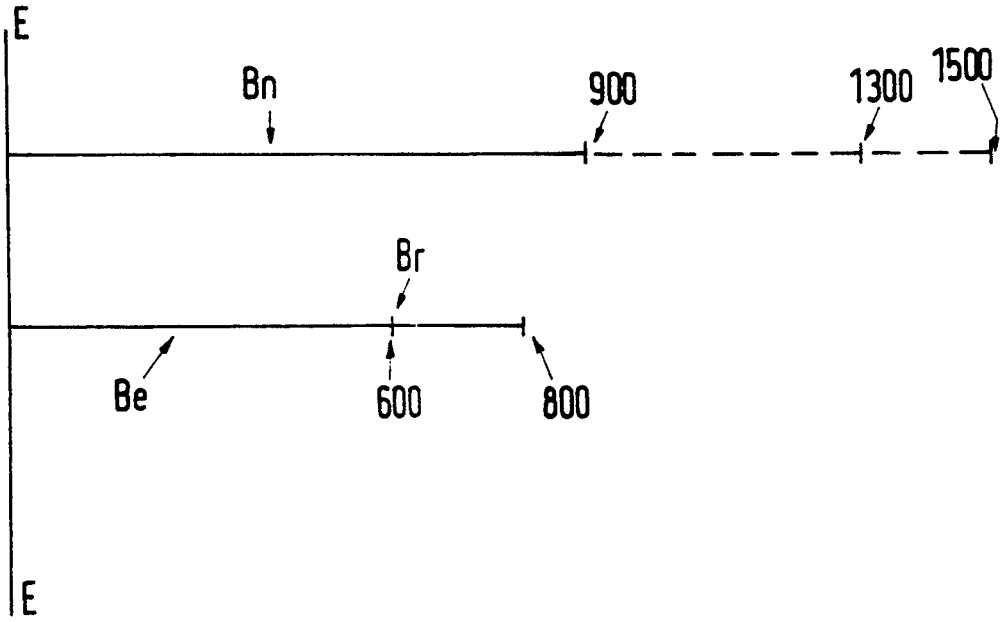
FIG. 6 is a diagram illustrating the relationship between the working width of a carding machine according to this invention and a carding machine of a present day conventional construction.

A carding machine or card according to this invention has a maximum working width B of 800 mm., and the working width B preferably amounts to considerably less than 600 mm. The relationship between the normal working width Bn presently used and a working width Be according to this invention is shown in the diagram of FIG. 6. Both the working widths Bn and Be are plotted from the same zero plane or axis E—E. The full line Bn represents the minimum working width used at the present time which amounts to 900 mm., whereas the dashed line represents the increase to the maximum working width of 1500 mm. On the other hand, the full line Be represents to the same scale the maximum working width of 800 mm. of a carding machine constructed according to this invention, whereas the preferred range from 600 mm. (and less) is shown with the limiting line Br.

Figure 7:
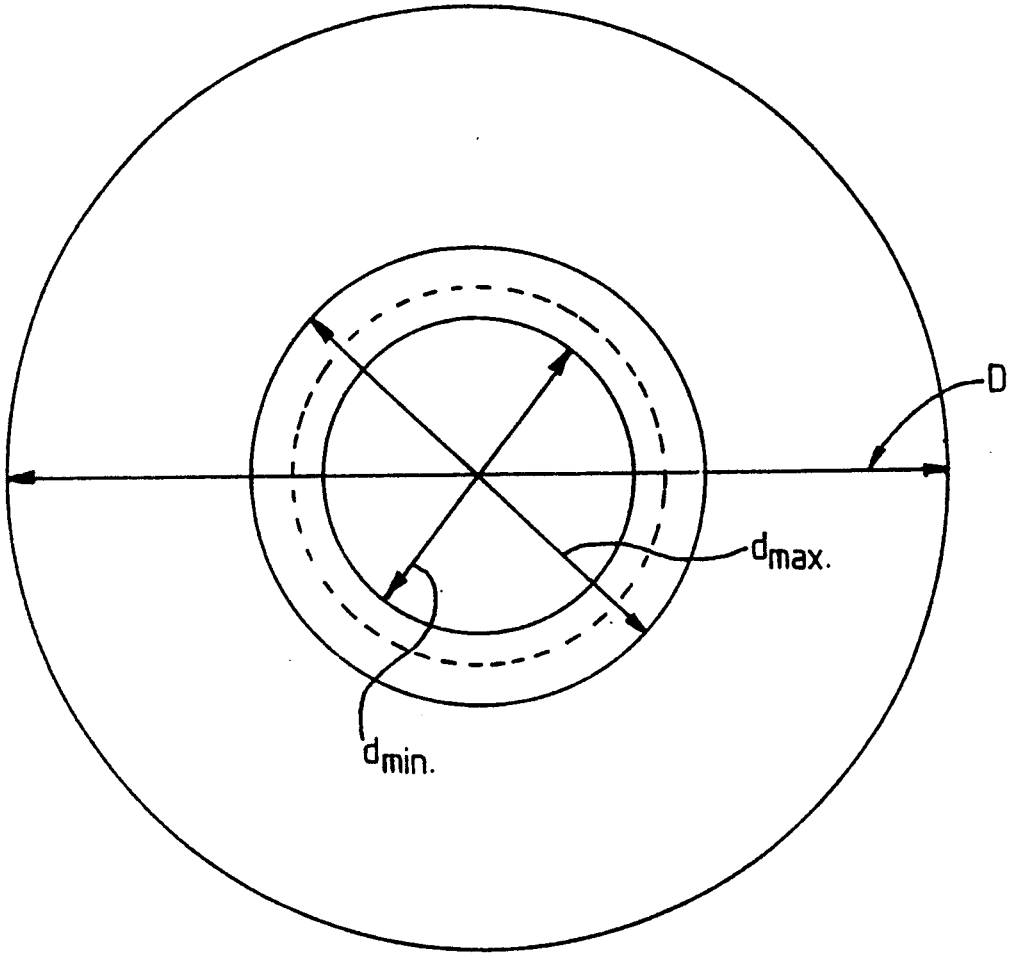
FIG. 7 is a diagram illustrating the relationship between the diameter of a carding cylinder of a carding machine according to this invention and the diameter of a carding cylinder of a carding machine of a present day conventional construction.

FIG. 7 shows the corresponding relationships for the most usual presently employed diameters (D=1300 mm.) of a carding cylinder of a carding machine and the maximum and minimum diameters (dmax=600 mm., dmin=400 mm.) of a carding cylinder 50 for a carding machine or card according to this invention. The preferred diameter d of 500 mm. is indicated with a dashed line.

Figure 8:
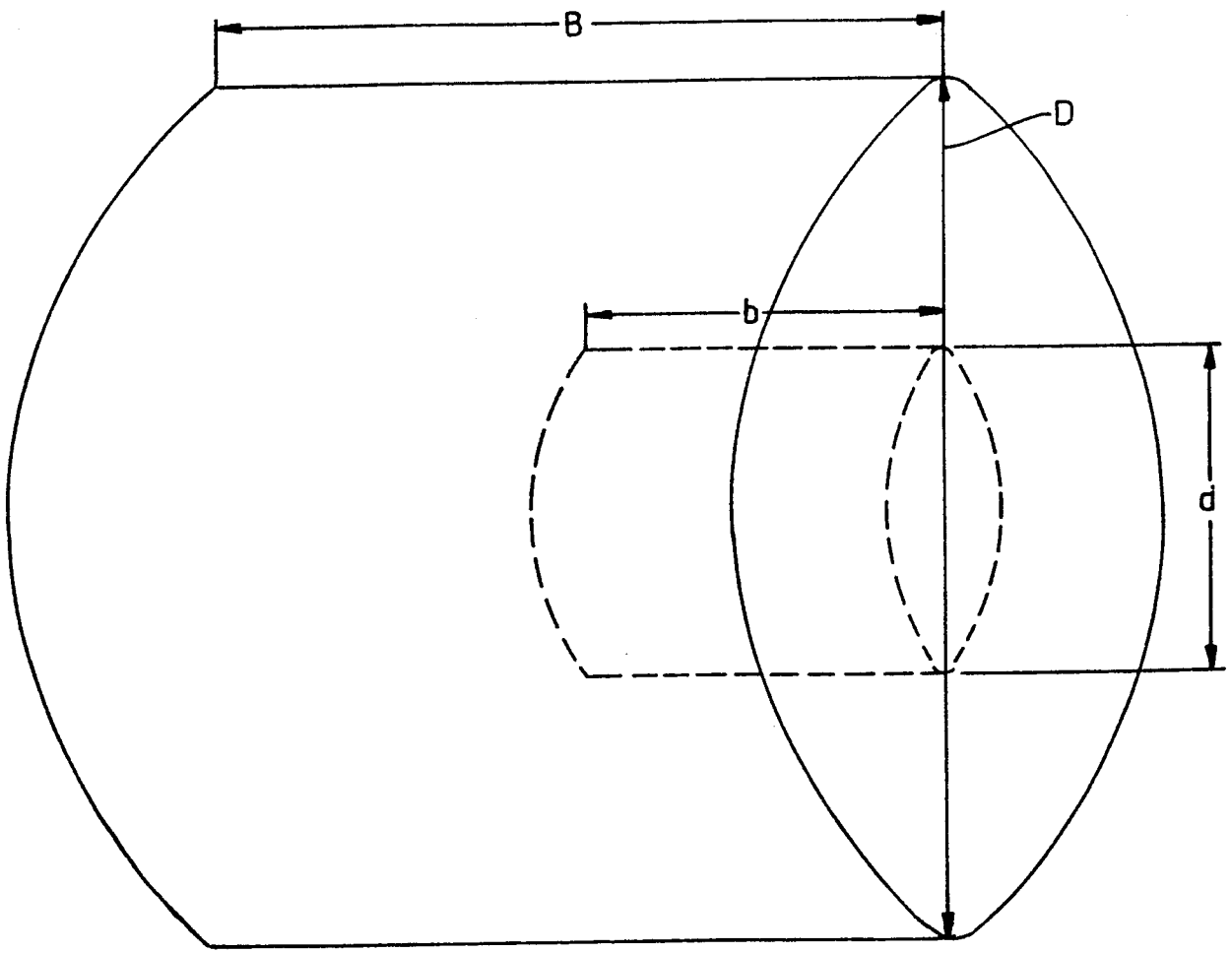
FIG. 8 is an isometric recapitulation of the dimensional relationships portrayed in FIG. 6 and FIG. 7.

The schematically represented relationships in FIGS. 6 and 7 are summarized in the isometric representation of FIG. 8 with carding cylinder dimensions d of 500 mm. with a working width b of 500 mm. compared with the presently usual diameter D of 1300 mm. and a working width B of 1000 mm.

Figure 3:
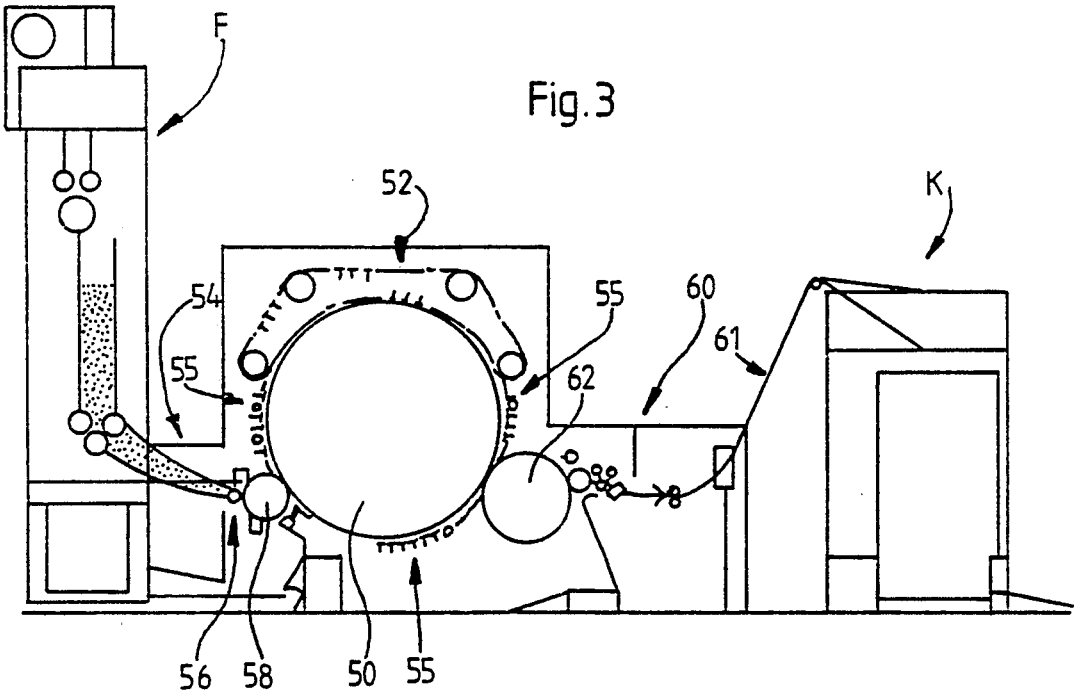
FIG. 3 is a schematic representation of the carding machine according to FIG. 1 together with its feeding and doffing systems.
Figure 9:
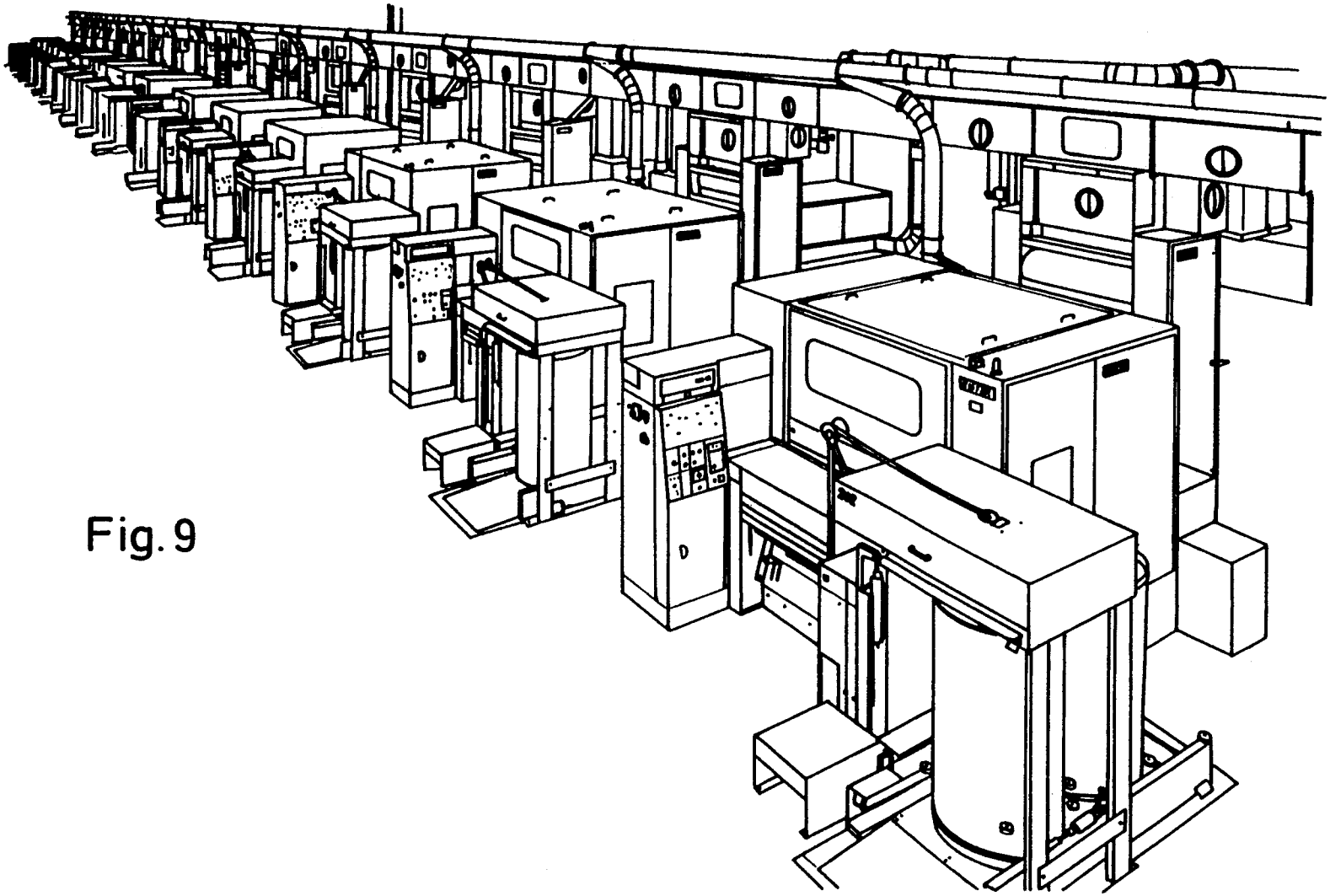
FIG. 9 is a photograph of a carding room of a spinning mill equipped with commercially termed C4-carding machines or cards of the assignee of the present invention.

FIG. 9 shows a photograph of the card or carding room of a spinning mill which is equipped with cards from the C4-series of models of the assignee. At the date of the present application, about 5000 carding machines or cards of this type are in use all over the world. The aforementioned working elements are not visible in FIG. 9, because the machine is fully encased for the protection of it surroundings. Accordingly, in FIG. 9, there is only visible the outer casing formed from sheet metal parts. FIG. 9 also shows the chute or tower feeder (F in FIG. 3) which serves for the delivery of fiber material in the form of wadding or the like to the feeding or feed system 54 (FIG. 3) and, for each carding machine, a can coiler (K, FIG. 3) which serves for the take over of the silver 61 delivered from the doffing system 60 (FIG. 3). FIG. 9 also shows that the card room does not consist of one single machine but rather of a group of machines. The single machines each represent a module or building block of the machine group. The card room as a whole requires a correspondingly large amount of space. This invention does not envisage any substantial alteration in the chute or tower feeder F and the can coiler K, so that it should be stated at the outset that no substantial reduction of the space required for these sub-assemblies or structural groups can be expected without an alteration in the complete arrangement, as will be further described shortly. The reduction of the working width of the chute or tower feeder corresponding to the reduction of the working width of the card can be neglected as being of secondary importance.

Figure 10:
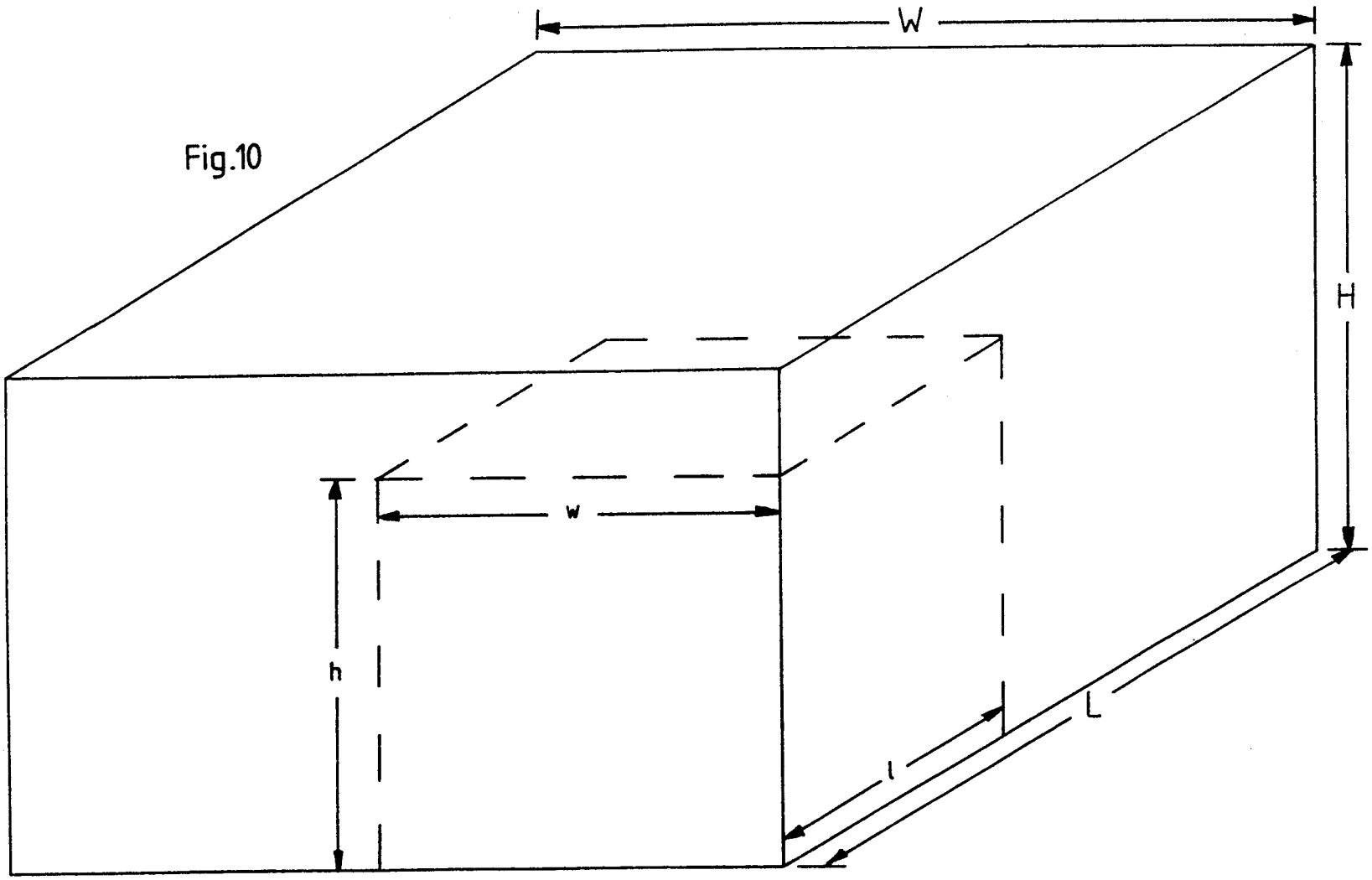
FIG. 10 is a diagram schematically representing the relationship between the place required by a carding machine or card of a present day usual construction and a carding machine or card constructed according to this invention.

FIG. 10 shows in full or solid lines the casing of the C4-carding machine with a length L of 2450 mm., a width W of 3050 mm. and a height H of 2000 mm. With dashed lines and to the same scale, the same FIG. 10 shows the casing for a carding machine constructed according to this invention with a length 1 of 1050 mm., a height h of 1600 mm. and a width w of 1600 mm.

SUMMARY OF THE FUNDAMENTAL IDEA

FIGS. 5 to 10 particularly show the external effects of a departure from the past and indicate a few advantages of the obtained results. These results do not, however, themselves represent the fundamental idea of the invention.

The prior developments in respect of the carding machine were directed to increasing the effective working surface, where "effective working surfaces" should be understood to mean the number of working elements multiplied by the working width. Attempts were then made to ensure for accuracy with the maximum effective working surface.

According to this invention, it is not the working surface but rather the accuracy (precision) which should be the focal point.

The essential knowledge or recognition which has been made is that the precision is impaired by an enlargement of the working surface. Consequently, the working surface should not be enlarged, rather reduced, and then, in such a manner that the precision, and as a result thereof, the effective utilization of the available working surface is considerably increased. The key to an increase in the precision resides in the reduction of the working width. This key, however, opens the door to a range of further possibilities, which, in part (as for instance the reduction of the diameter of the carding cylinder) were already recommended in the past, but could only be realized heretofore with difficulty or were actually technically and economically impractical. Further possibilities for increasing the precision are now described by means of the further figures.

Further Development of the Fundamental Idea

Base frame or frame

The licker-in 58 and the doffer 62 (FIG. 3) are also provided with a respective clothing (not shown). It is necessary to mount the carding cylinder 50, the licker-in 58 and the doffer 62 by means of a frame in a predetermined arrangement in relation to each other, in order to achieve the desired effect at the positions or locations where their clothing elements are close to each other. The frame must maintain the predetermined relationships of these working elements throughout the entire service life of the carding machine.

Figure 11:
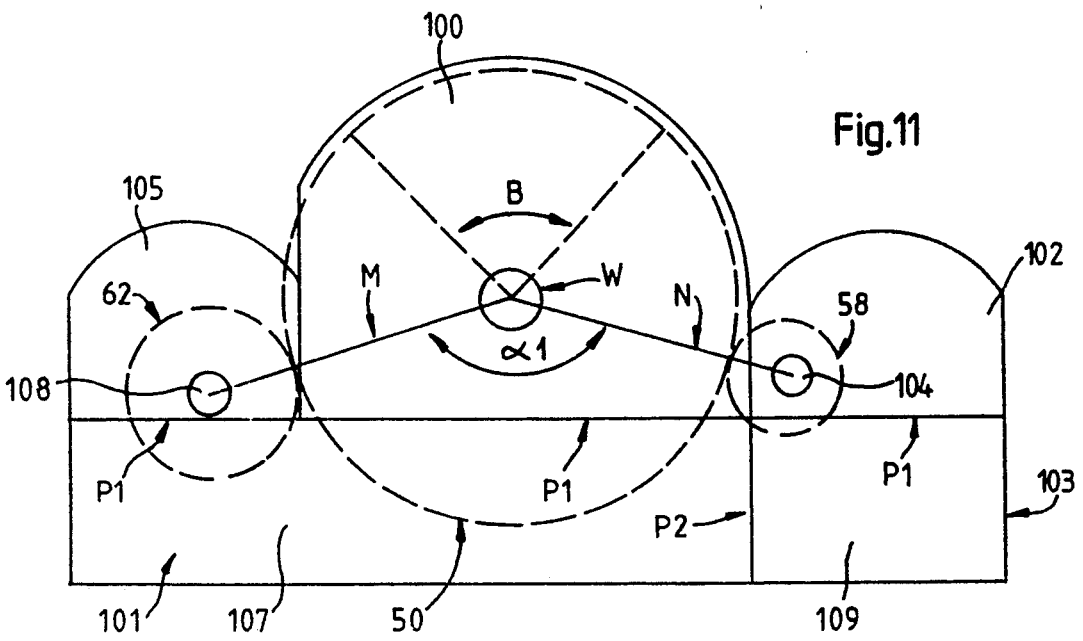
FIG. 11 is a schematic view of the side structure of the frame or casing of a carding machine or card of a present day conventional construction.

FIG. 11 schematically shows the conventional structure of the present day frame of a C4-carding machine. The aforementioned elements are divided into three sub-assemblies for the installation, namely:

the sub-assembly of the carding cylinder 50 itself with two vertical frame side walls 100 (only one side wall 110 is visible in FIG. 11) which serve as carriers for the end parts of the shaft W;

the sub-assembly of the feeding system 54 with side carriers 102 (only one side carrier 102 is visible in FIG. 11) at least for the ends of the shaft 104 of the licker-in 58; and the sub-assembly of the doffing system 60 with side carriers 105 (only one side carrier 105 is visible in FIG. 11) at least for the end parts of the shaft 108 of the doffer 62.

Each of these three sub-assemblies can contain further rollers, for example the feed roller which is supported by the associated side wall. These further rollers are, however, not shown in FIG. 11, as they do not play any part in the following considerations. The side carriers 100 and 105 for the carding cylinder and doffer sub-assemblies, respectively, are mounted and fastened on the side walls 107 of an underframe 101. A second underframe 103 borders on the underframe 101, the side walls 109 of which carry the doffer sub-assembly.

The distance or spacing N between the axes of the carding cylinder 50 and the licker-in or licker-in roll or cylinder 58 and the distance or spacing M between the axes of the carding cylinder 50 and the doffer or doffer roll or cylinder 62 each should be exactly adjustable. With the arrangement according to FIG. 11, these distances N and M are substantially influenced by the contact (or non-contact) of the surfaces P1 of the side carriers on the side walls and the surfaces P2 of the underframe.

Figure 12:
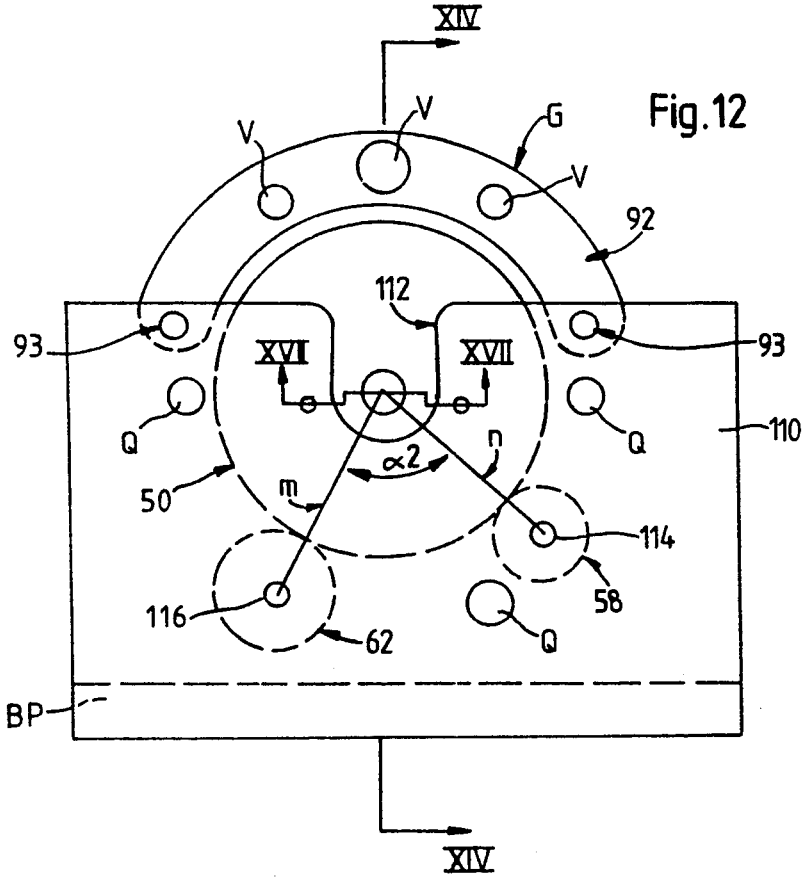
FIG. 12 is a schematic view of a side wall for a preferred arrangement of the frame or casing of a carding machine or card according to this invention, together with transverse connecting elements which form a rigid base frame together with the side walls.

FIG. 12 shows, on a larger scale than that of FIG. 11, a preferred frame for a carding machine according to this invention. This frame contains two vertical or upright side walls 110 (only one side wall 110 is visible in FIG. 12). These side walls 110 are connected together to form a so-to-speak closed base frame G by means of a base plate BP, three transverse connections Q and the revolving flat structure G containing several transverse connections V, the transverse connections Q and V being provided above, below and on both sides of the carding cylinder 50, to thus allow the resulting base frame G to be considered more or less as a closed framework. The transverse connections Q are situated as close as possible to the carding cylinder 50, in order to impart to the structure the greatest possible stiffness or rigidity.

Each side wall 110 is provided with a slot 112 and two openings 114 and 116. The opening 114 secures the shaft 104 of the licker-in 58, the opening 116 secures the shaft 108 of the doffer 62 and the slot 112 secures the shaft W of the carding cylinder 50. The sub-assembly of the carding cylinder 50 is positioned and fixed in the side walls 110 through centering bolts 162 (FIG. 17) inserted into openings Z. These openings Z, 114 and 116 can be formed as holes or bores during a single clamping or chucking of the side wall 110 as a workpiece during the manufacturing operation. This makes possible a particularly exact predetermination of the distance n between the longitudinal axis of the carding cylinder shaft W and the longitudinal axis of the licker-in shaft 104, and equally the distance m between the longitudinal axis of the carding cylinder shaft W and the longitudinal axis of the shaft 108 of the doffer roll 62. According to the same principle, all the remaining rotating or adjustable parts, for example the feed roller, delivery cylinder, carding plates on the carding cylinder 50 or on the licker-in 58, are supported at the side walls 110. The side walls 110 are preferably formed from a single part, for example a casting. Where this does not apply, connections between the side wall parts should be accomplished before the formation of the openings Z, 114 and 116.

The distances n and m are naturally much smaller than the distances N and M, not only because the diameter of the carding cylinder 50 is smaller according to the invention, but also because the diameter $\phi$ of the licker-in 58 and the diameter $\phi$ of the doffer 62 are also preferably reduced, and specifically in the relationship to the reduction of the diameter of the carding cylinder 50. This means that for a carding cylinder with a diameter from 400 mm. to 600 mm., the following dimensions should apply:

| | | |
|---|---|---|
| Licker-in: | $\phi$ | 90 mm. to 150 mm. |
| Doffer: | $\phi$ | 200 mm. to 300 mm. |

Operating Speed or Centrifugal Forces

With a reduction of the diameter of the carding cylinder 50, the rotational speed of this element or component must be increased, in order to retain the present day usual peripheral speed. The reduction of the diameter of the carding cylinder 50 and the working width lead, however, to a reduction of the effective working surface, which must be compensated as regards the maintenance of the material throughput by an increase of the peripheral speed beyond that which is usual at the present time. If, as preferably contemplated, capacity for a further increase in production should be afforded, this connotes a further increase of the peripheral speed. The attendant increase of the speed of rotation of the carding cylinder 50 leads to a corresponding increase of the centrifugal forces acting upon the material being processed. This affords the advantage of an improved separation of heavy particles.

The increased centrifugal force exerts an effect upon the fibers, so that there should be expected an increase in the ends of the fibers protruding from the roller clothing. These fiber ends are flung against the oppositely situated surfaces of the clothing of the rolls or rollers. As a result, increased friction prevails between the fibers and the clothing. Consequently, the imparted form or shape and surface finish of the clothing plays a more important role than heretofore. Preferably, each surface which is not provided with clothing is machined in order to determine the form and structure of the fiber feeding surface.

The air budget in the working gap also could play an important role. As this air does not bring any advantage, it is advantageous to maintain the air quantity as small as possible, possibly with partial evacuation.

Machine Geometry

FIGS. 11 and 12 also show a further difference, namely, the alteration of the geometry of the complete arrangement. The geometry can be represented through the angle $\alpha$, which is formed between the lines M and N (angle $\alpha_1$) or between the lines m and n (angle $\alpha_2$). The angle $\alpha_2$ is substantially smaller than the angle $\alpha_1$, which increases the available surface of the carding cylinder 50 in its direction of rotation between the licker-in 58 and the doffer 62. With regard to the required fiber flow per unit of working surface, the increase in the available working surface between the licker-in 58 and the doffer 62 is advantageous, as the main carding work must take place in this area. Nevertheless, there is space available in the undercarding zone UKZ for the provision of a small number of additional carding rods. These additional carding rods can be formed and arranged according to the commonly assigned, U.S. application Ser. No. 07/621,979, filed Dec. 4, 1990, and entitled "Apparatus for Cleaning and/or Carding Textile Fibers, to which reference may be readily had and the disclosure of which is incorporated herein in its entirety by reference.

The smaller dimensions of the carding machine itself make possible a space-saving arrangement of the combination of chute feeder, card machine and can coiler, that is, an arrangement which reduces the space required for these three building blocks or modules. A carding machine or card according to FIG. 12 could be, for example, rotated through an angle of 90° about the longitudinal axis A—A of the carding cylinder 50, so that the licker-in 58 is arranged on the "upper side". The chute or tower feeder F (FIG. 3) could then be erected above, instead of next to, the carding machine. In an arrangement of this type, or in combination with an arrangement according to FIG. 12, the can coiler K (FIG. 3) could be erected underneath, instead of next to, the carding machine.

Revolving Flat Arrangement

Figure 13:
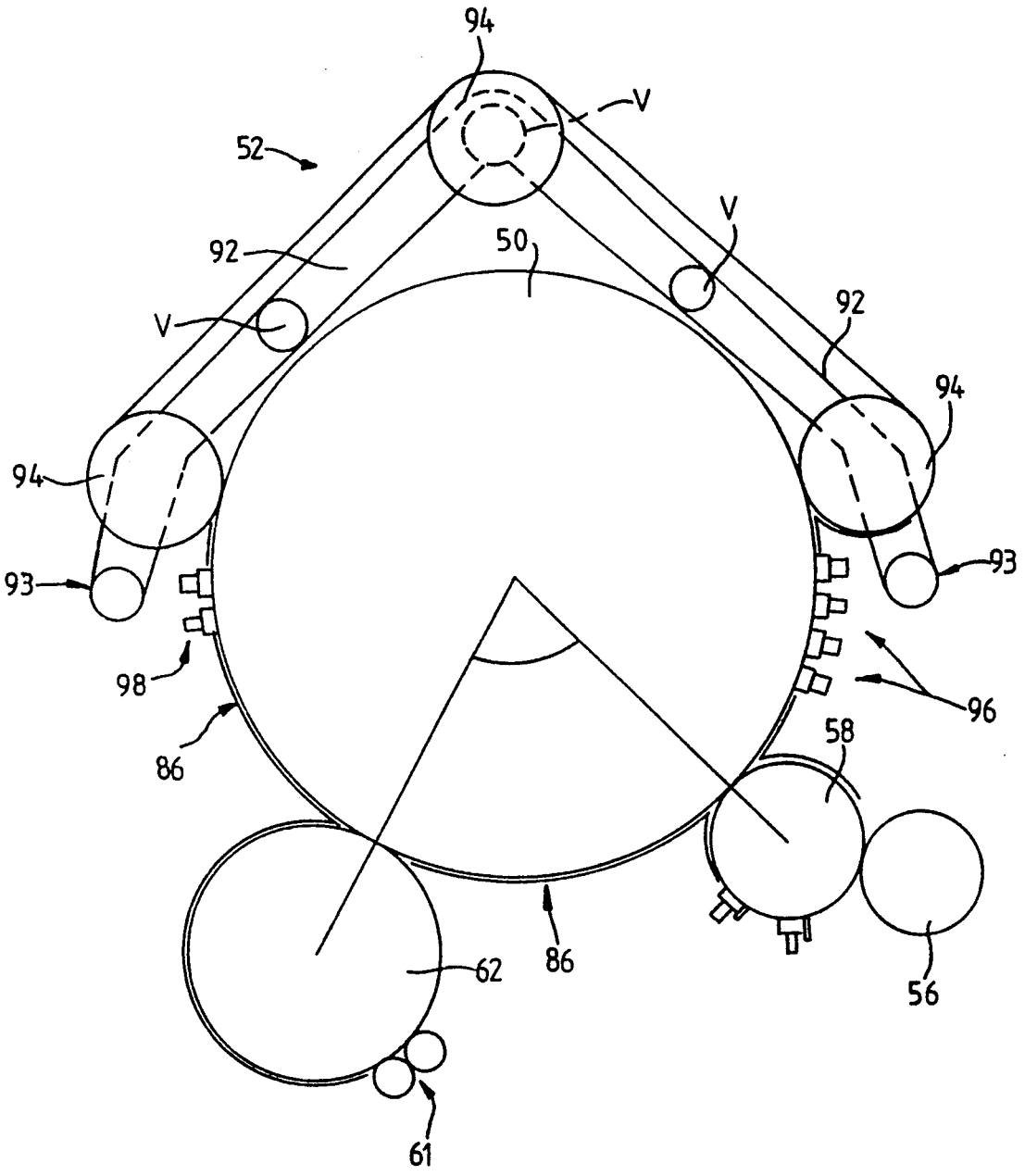
FIG. 13 illustrates a preferred "geometry" of the working elements of a carding machine according to this invention.
Figure 14:
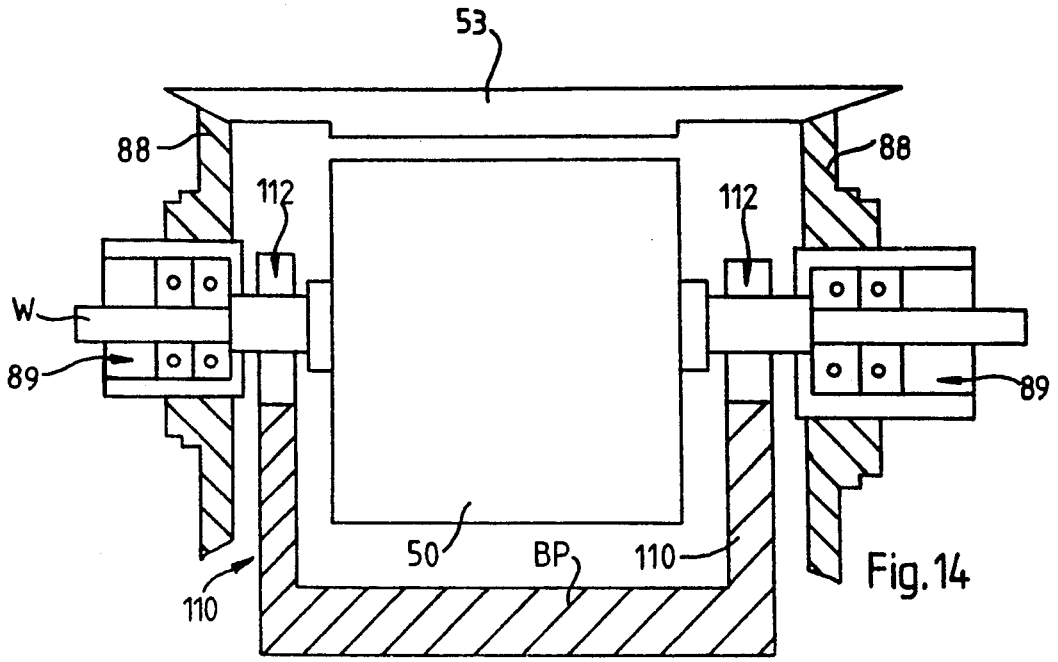
FIG. 14 illustrates a preferred arrangement of the guide structure for the flat rods.
Figure 15:
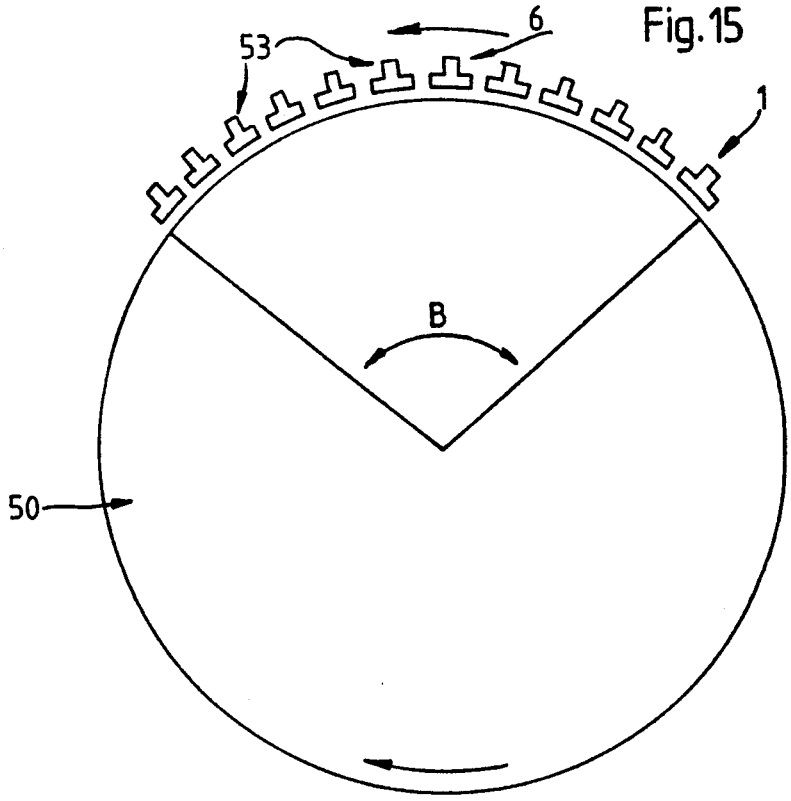
FIG. 15 is a schematic representation of the arrangement of the flat rods in the working position of a carding machine according to FIG. 14.

A suitable revolving flat arrangement for the new type carding machine is now described in conjunction with FIGS. 13, 14 and 15. FIG. 14 schematically shows a section in the plane or along the section line XIV—XIV of FIG. 12. Guiding or guide discs 88 are mounted directly by bearings 89 on the shaft W of the carding cylinder 50, and these discs 88 can rotate about the shaft W during operation as a function of the movement of the flat rods 53. To this extent, this system is analogous to European Patent No. 232,018 (Reference 9). The "arc" is only on the guide discs 88 for this reason, but encompasses the same angle $\beta$ as the arc in FIG. 1.

FIG. 15 shows that in the new carding machine or card, because of the reduction in the diameter of the carding cylinder 50, space is only available for twelve conventional flat rods 53 in the operating position (along the arc encompassing the angle $\beta$) in relation to the carding cylinder 50. These flat rods 53 are identical with those in use at the present time. A more detailed description of such flat rods is to be found in Reference 3, for instance. In a usual carding machine of the present time, the guide arc has space for about 40 rods (Reference 11).

The reduction of the number o fiber processing elements in the revolving flat arrangement represents a reduction of the carding work, which must be compensated through the higher precision. However, it has been determined that the reduction in the carding work is not proportional to the reduction in the number of flat rods 53. It is known (Ref. 3) that the greater part of the carding work is already carried out when the flat rods enter the arc, that is, during the time that the flat rods are moving from position 1 to position 6 in FIG. 15. A certain reduction in the number of flat rods along the arc or arcuate path, therefore, in many cases, does not result in any substantial disadvantages.

Nevertheless, under certain circumstances, it can prove necessary to provide more than 12 flat rods 53 in the working position. A flat rod 53 of a construction which is usual at the present time is not equally effective over its entire working width, but rather mainly operates in the marginal regions at the edge which trails in the direction of rotation, that is to say, at the "heel". The width of the flat rods in a carding machine according to the present invention therefore can be reduced, as they possess the necessary rigidity in any case due to the reduction in the working width. The flat rod width can be, for example, halved compared with the present day flat rod constructions and the number of flat rods in the working position consequently ca be doubled.

FIG. 13 shows the preferred geometry of the working elements, carding cylinder 50, revolving flat arrangement 52, licker-in 58, doffer 62 and any additional elements which are dealt with more fully in the following description. The side walls 110 (see also FIG. 12) carry a yoke 92 which is mounted by attachments or fastenings 93 on the side wall 110. The yoke 92 serves as carrier for the guide rolls or rollers 94 of the revolving flat arrangement 52. The revolving flat arrangement 92 or its frame (not shown) is reinforced by three transverse connections V which are connected with the yoke 92. The main carding zone encompasses an angle of about 110° about the carding cylinder axis A—A, the pre-carding zone an angle of about 50°, the re-carding zone an angle of about 50°, and the under-carding zone an angle of about 40°. The angle $\alpha$ amounts to about 65°. FIG. 13 also shows the feed roll or roller 56 and a pair of doffer rolls or rollers 61 at the doffer 62.

Carding Cylinder Covering

In the pre-carding zone VKZ there is an additional segment 96 with place for a dirt separation blade (not shown, but, for instance, constructed according to the aforementioned commonly assigned, U.S. patent application, Ser. No. 07/621,847, filed Dec. 4, 1990, and entitled "Main Cylinder Casing Segment". In the re-carding zone NKZ, there are provided carding rods 98 which can be formed similar to the flat rods 53. As already explained, there is place for up to 3 carding rods (not shown) in the under-carding zone UKZ.

The carding cylinder 50 is otherwise covered by plates 86 The inner surfaces of these covering plates 86, located opposite to the surface of the carding cylinder 50, are finished or treated so that a braking effect which is as small as possible is exerted upon the fibers in contact therewith. These covering plates 86 also must be exactly adjustable in relation to the carding cylinder 50 in order to ensure the desired fiber guidance or the predetermined air budget on the carding cylinder 50.

Figure 16:
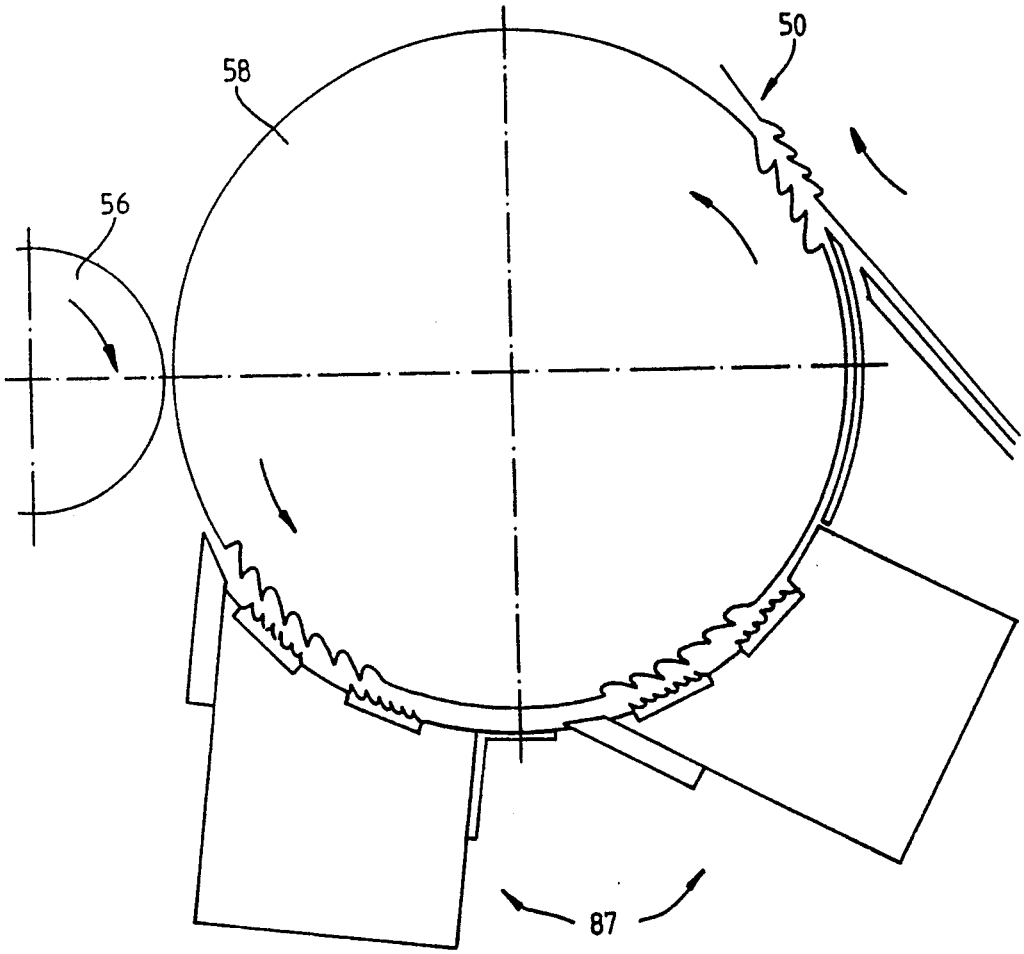
FIG. 16 is a schematic representation of the clothing of the licker-in or licker-in roll.

As already explained, the licker-in 58 and the doffer 62 are also covered except at their fiber transfer positions. The doffer 62 has covering plates like the covering plates 86 (FIG. 13) of the carding cylinder 50 and such covering plates also can be provided on the upper side of the licker-in 58 (FIG. 16). The licker-in 58 can also be provided on the underside with segments 87 equipped with carding rods (FIG. 16) to achieve a preliminary opening of the fibers. Such segments 87 are also already in use and are thus not here described in detail.

Carding Cylinder Suspension or Materials

Figure 17:
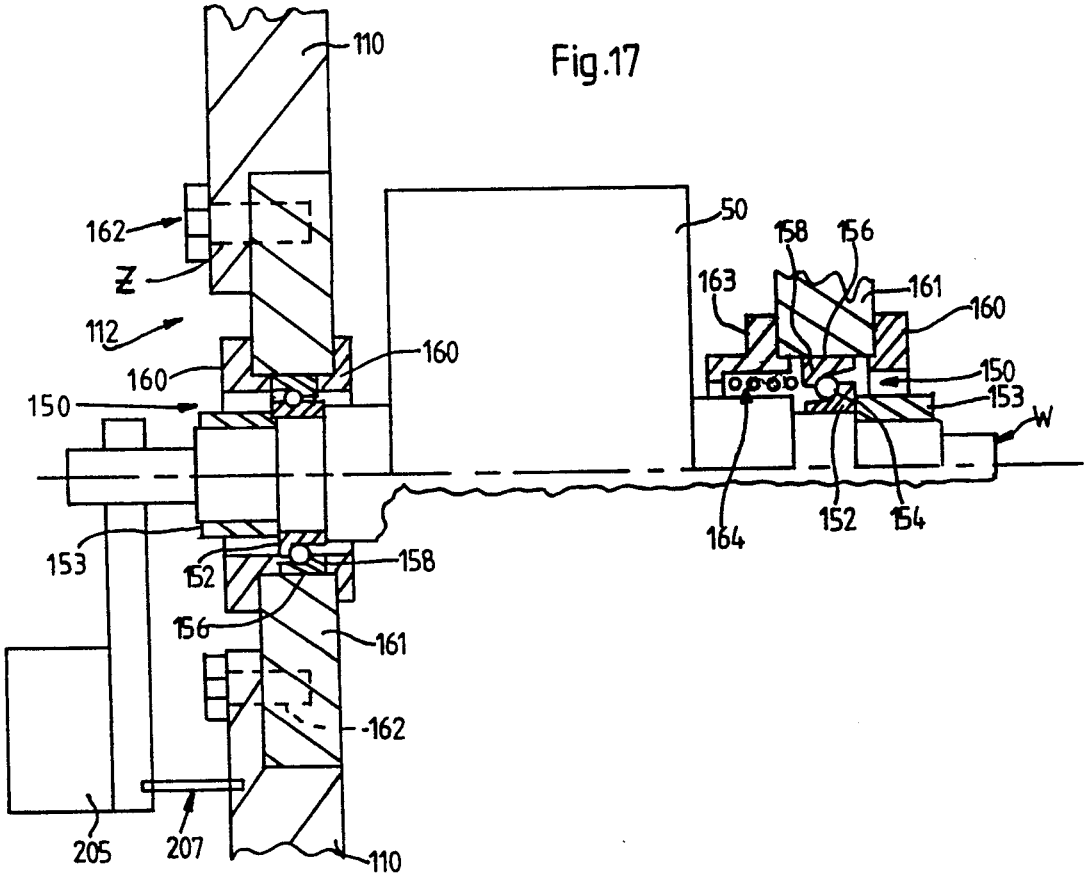
FIG. 17 is a schematic cross-section through a preferred supporting arrangement for the carding cylinder in a side wall according to FIG. 12.

FIG. 17 shows the preferred mounting or supporting of the carding cylinder 50 of a carding machine or card constructed according to this invention. The carding cylinder 50 is mounted on shaft W. The attachment is not shown in FIG. 17, but the preferred arrangements are described hereinafter by means of FIG. 18. Each end part of the shaft W is stepped in form and extends through the opening or slot 112 (FIG. 12) in the appropriate side wall 110. Between each side wall 110 and a shaft step lying in the opening 112, there is located a tapered rolling bearing 150. Each bearing 150 contains an inner race 152 which is only provided with a shoulder 154 on the end furthest from the carding cylinder 50. Each inner race 152 is fastened against the shaft W by a respective a nut 153.

Each bearing 150 also contains an outer race 156 which is only provided with a shoulder 158 on its end facing the carding cylinder 50. The outer race 156 of the bearing 150 shown at the left side of FIG. 17, is rigidly mounted through two flanged rings 160 and fastening screws or the like (not shown) in an annular intermediate part 161. The annular intermediate part 161 is fastened, as already explained, by the centering bolts 162 and centering openings or holes Z in the related side wall 110.

The outer race 156 of the other bearing 150 located at the right side of FIG. 17, is not rigidly fastened on the related side wall 110 or the appropriate intermediate part 161, but rather pressed axially via the intermediate part 161 by a spring 164 captured between its shoulder 158 and a ring or annulus 163 fastened on the side wall 110, in the direction of the shoulder 154 of the same bearing 150.

Play in both bearings 150, for example caused by wear or flattening of the ball bearing surfaces, is taken up by the spring 164. This bearing principle is known. Suitable bearings are obtainable from the well known firm SKF Kugellagerfabriken GmbH., located at Pragerstrasse 136, D-7000 Stuttgart-Bad, Germany, under their commercial designation, Type 7209 CD.

FIG. 4 also schematically shows the hollow cylindrical part of the carding cylinder 50 as well as its side shields or plates 66, however without representing the connection of these elements with each other and with the shaft W. These connections also can be present in conventional manner in a carding cylinder 50 constructed according to this invention. The carding cylinder 50 can be formed by a casting, like the usual carding cylinder at the present time.

Figure 18:
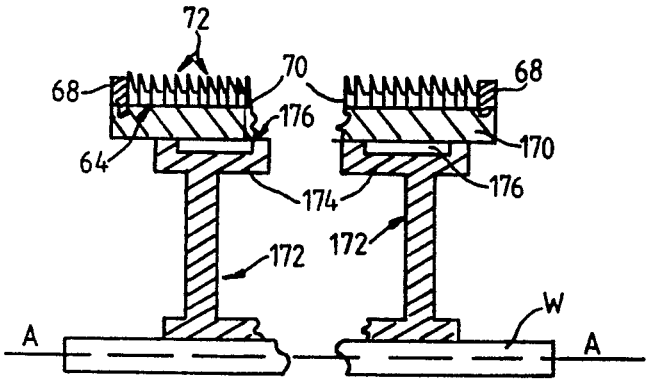
FIG. 18 is a schematic representation of a preferred connection between the cylinder structure of the carding cylinder and its carriers or supports.

The hollow cylindrical part 170 of the carding cylinder 50 (FIG. 18) is, however, preferably formed from a material with a considerably higher modulus of elasticity, for example, from steel. This hollow cylindrical part or cylinder 170 can be produced by performing a turning or lathe operation on a steel tube serving as the blank, so that all the important surfaces can be machined. The side shields or plates 172 are preferably formed from the same material and can contain flexible parts, so that any radial forces between the cylindrical part or cylinder 170 and the side shields or plates 172 lead to a distortion of the shields or plates 172 rather than to a distortion of the cylindrical part or cylinder 170. In FIG. 18, each side shield or plate 172 is depicted as being connected with the cylindrical part or cylinder 170 via a respective substantially U-shaped, outer edge part 174, so that this part 174 forms a narrow gap 176 with the associated cylindrical part or cylinder 170 and the flexible part of the side shield or plate 172.

The use of new materials with higher moduli of elasticity with low specific weight (fiber reinforced plastic, for example) would be possible in the cylindrical part or cylinder 170. A cylinder formed from such a material could be, for instance, connected with the shaft W through a "filling" of porous material. Such materials have low thermal expansion. Fillings or fillers, however, also can be provided in order to ensure that the heat is conducted away from those areas where high waste heat exists.

Construction of Modules

Because of their low weight and small dimensions, it is relatively easy to remove a carding machine or card constructed according to the present invention from the "processing line" (cf. FIG. 9) for maintenance or servicing purposes, and a replacement o substitute machine is advantageously installed to maintain the complete production. However, FIG. 19 shows a further possibility of simplifying the installation or the maintenance work in a carding machine constructed according to this invention.

Figure 19:
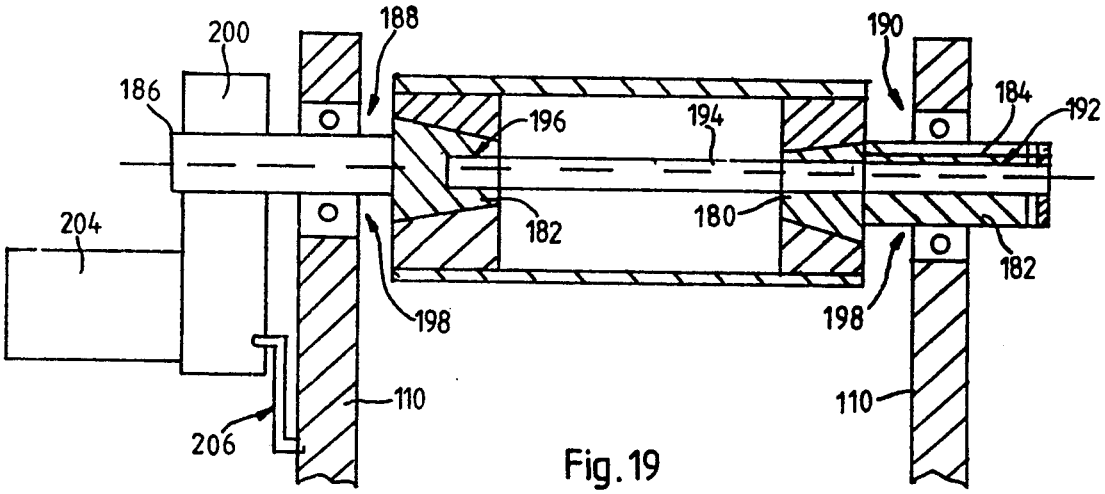
FIG. 19 is a schematic representation of the preferred suspension of a working roller in the side walls according to FIG. 12.

Each working roll or roller (for instance, the licker-in 58 and/or the doffer 62) can be mounted by a suitable suspension in the side walls 110 according to FIG. 19. This suspension contains two cone elements 180 and 182, each provided with a stub axle or shaft 184 and 186, respectively, which is held in the related side wall 110 in an appropriate opening 188 and 190. Each cone element 180 and 182 is held in a correspondingly tapered opening provided in the front face of the working roller.

The one cone element 180 and its stub axle or shaft 182 has a longitudinal bore or hole 192. A pin 194 extends through this bore 192 into a threaded or tapped hole 196 of the other cone element 182, in order to hold both cone elements 180 and 182 rigidly together with the working roller. The stub axles or shafts 184 and 186 are supported by suitable bearings 198 in the side walls 110.

The stub axle or shaft 186 of the cone element 182 has a coupling part 200 on the free end thereof which can be coupled with a gear unit (not shown) of a suitable geared motor 204 or the like. The geared motor 204 is secured against rotation, by an appropriate connection 206, at the related side wall. The module can easily be dismantled in that the geared motor 204 is removed, the pin 194 is released or slackened and the cone elements 180 and 182 are drawn out through the bearing openings in the side walls 110, and the working roller itself can be lifted out of the space between the side walls 110. The mounting of a substitute unit can be correspondingly carried out in the reverse sequence, without disturbing other elements of the carding machine.

The revolving flat arrangement 52 (FIGS. 12 and 13) forms a further module, which can be lifted out of the side walls 110 as a unit by releasing or slackening the attachments or fastenings 93 and thereby exposing the carding cylinder sub-assembly. The carding cylinder 50 is driven by a suitable drive motor 205 (FIG. 17) through the shaft W which, like the geared motor 204 of FIG. 19, is secured against rotation via a suitable connection 207 with the side wall 110. Through the removal of the drive motor 205 and the release or slackening of the centering bolts 162 (FIG. 17), the carding cylinder sub-assembly also can be removed from the side walls 110 without requiring the dismantling of the other sub-assemblies.

Type of Clothing

The description up to this point is based on the assumption that the type of clothing usual at the present time will continue to be used. A carding machine or card according to the invention can be realized on this basis. It can, however, be improved still further by the use of new clothing, as is shown by the further figures.

By means of FIG. 4, the usual type of clothing in use at the present time (all-steel clothing) for the carding cylinder is briefly described (and further details are obtainable from the References 1 to 5). The all-steel clothing has brought substantial advantages, but requires maintenance over its whole service life, and different aspects of the clothing must be taken into account.

According to FIG. 20, it is now envisaged that a new type of clothing should be provided for the carding cylinder 50, and specifically, a clothing which consists of points or tips, for example needles, rigidly held in a carrier. Certainly, clothing containing needles for the licker-in is known in practice, according to Reference 10. A clothing of this type for the carding cylinder has also been proposed, but heretofore has not been realized in practice, however, because of its much higher point density.

Equipping the working surface of the carding cylinder in this way is also capable of realization on a conventional carding machine and would also bring the technological advantages described in the following. It would, however, be relatively easy to realize where this working surface itself is reduced in size, and, at the same time, the requirements of precision of the clothing are substantially increased.

FIG. 20 again shows a part of the cylindrical surface 64 of the carding cylinder 50. The lines R1 represent radii of the carding cylinder 50. This carding cylinder 50 is equipped with needles 120 which are each separately formed and pressed or adhesively bonded into individual seats (holes) in the jacket and are thus rigidly held. The points of these needles lie as closely as possible to a jacket surface Mt.

Important setting parameters for the behavior of the clothing in a carding machine are the angles of the saw teeth in relation to the longitudinal direction of the wire (References 4, 5 and 6). On the carding cylinder, each such parameter is translated into an angle of the relevant flank in relation to a tangent (or a radius) of the jacket of the carding cylinder, and all the points of the carding cylinder are arranged in the direction of rotation of the carding cylinder.

If a needle is regarded as a working element of the carding cylinder clothing, then the angle (the "working angle") of its "working flank" in relation to a radius (a tangent) of the carding cylinder is also to be regarded as an important parameter of the carding cylinder. If each needle, for example as for the round cross-section depicted in FIG. 20A, is formed axially symmetrical over the entire longitudinal axis, then, the angle, for example the angle e of this longitudinal axis in relation to the radius or in relation to the tangent of the carding cylinder, can be treated as an important parameter.

This does not apply when the needle is not axially symmetrical over its entire length, for instance, but is rather like the needle in FIG. 22, with its point S is formed to a flank. In this case, the angle between the working flank AF and the radius R (or the tangent) is to be regarded as a setting parameter. The point S can be located on the working flank AF (FIG. 22) or on the diametrically opposed working flank in the opposite direction (not shown).

When the needle is not axially symmetrical over its entire length, problems could result when the foot of each of the needles is circular, as the needle then can be incorrectly set when pressing-in. Such needles could, for example, have a rectangular cross-section (FIG. 20B), or a triangular cross-section (FIG. 20C). In the latter case, the working flank AF could be rounded (FIG. 20C) or formed as a plane (FIG. 20B).

The needles are preferably not inserted directly into the body of the carding cylinder, but are rather fastened in carrier or support rods 122 (FIG. 23) which are located next to each other on the cylindrical surface of the carding cylinder and thus form an outer jacket. The rods 122 are then preferably exchangeable singly or as a group, as they are fastened singly or in groups on the carding cylinder. Preferably, a group of rods are grouped together in a segment by connecting elements and the segments are fastened with suitable connecting elements on the side flanges of the carding cylinder. The working angles of the needles are then determined in relation to the surface of the rods.

A suitable clothing is shown in the commonly assigned German Patent Application No. 3,914,543, dated May 2, 1989.

The same rods 122 also can be used as flat rods (FIG. 21) and in stationary carding segments (FIG. 21A). In both figures, a direction of rotation of the carding cylinder (not shown) is taken as being in the clockwise direction. However, whereas the needles in the carding cylinder must all have the same working angle, this is not absolutely essential for the flat rods and the stationary carding segments. As is shown in the aforementioned commonly assigned, U.S. application Ser. No. 07/621,979, filed Dec. 4, 1990, and entitled "Apparatus for Cleaning and/or Carding Textile Fibers, for example, it can be found to be an advantage when the working angle of the clothing of the outer working elements about the carding cylinder is altered. It can even also be found to be advantageous to provide the needles of the carding segments with a "negative" working angle (FIG. 21A), that means, the points of these needle points extend in the direction of rotation of the carding cylinder. FIG. 21A also shows a further variant of this shape of the needle with a taper over the entire length of the needle or at least over its free length, that is, the part outside of the carrier rod. The carrier rods, however, all have the same working angle with respect to each other, and specifically a "positive" angle (FIG. 21), that is, the points or tips of the needles point away from the direction of rotation of the carding cylinder.

The needle rods are preferably made from an easily deformable material (for example aluminum or brass). In use, they must be fixed to rigid rods. These can be steel, like the carding cylinder or formed from another material with a higher modulus of elasticity.

The main advantage of the needles as a clothing for the carding cylinder and the flat rods lies in a substantially longer service life than that attained by the all-steel clothing usual at the present time. This advantage is naturally also available when the needle clothing is inserted in a conventional carding machine. The combination of the needle clothing with a carding machine constructed according to this invention is, however, a particular advantage, as the working surface of the carding cylinder is reduced through the teachings of the present invention, which, on the one hand, reduces the clothing expenditure and, on the other hand, increases the utilization of this clothing per unit of time with the same or increased production per carding machine.

Precision

A considerable improvement in the precision is an object of the present invention. The term "precision" here has two different meanings:

on the one hand, the maintenance of a predetermined setting over the entire working width, which renders possible a more effective utilization of the working surface; and on the other hand, closer settings, which render possible a more intensive processing of the fibers per unit of the working surface. (See FIG. 2).

The closer settings (Effect 2) are made possible through the improved settings (Effect 1).

The precision of the arrangement of individual parts is determined by the following factors:

the dimensional accuracy of the parts themselves (for example, flat rod, carding cylinders) and the accuracy of the working gap therebetween.

Short or smaller elements can be produced more accurately. They can also be clothed more accurately, for instance, in principle, such measures can be selected so that each needle is adjustable in the jacket surface Mt (FIG. 20).

The precision is, however, not only important during the (static) assembly but rather even more so during the (dynamic) operation. The manufacturing precision must be substantially retained and, indeed, as far as possible during the service life of the machine.

The smaller working width according to this invention leads directly to Effect 1 (better observance of the settings) in operation, because it makes possible an increase in the rigidity of all the working elements of the carding machine or card. The reduction of the diameter of the carding cylinder results in less thermal expansion as well as less expansion in the presence of the centrifugal force. The reduction of the carding cylinder diameter and the smaller working width result in a more compact construction and a weight reduction. These lead to an improvement of the frame, which makes possible a much more exact predetermination of the mutual position of the roller axes. The use of a play-free bearing for the carding cylinder affords better retention of the desired settings over a long period.

The improvement in the precision makes possible a substantial increase in the fiber throughput per unit of working surface. Consequently, the smaller working surface of the carding cylinder is in a position to augment an increase in production when compared with present day carding machines or cards.

Additional Effects

The smaller dimensions reduce the required amount of space. At the same time, when maintaining or increasing production the smaller dimensions lead to an improvement in the cleaning effectiveness. These, together with increased effectiveness of the utilization of the working surface, result in fewer technological elements, which reduce the setting work as well as the maintenance work. The carding process is clearer and easier to control, which is important for the automation of the complete spinning process. The higher efficiency leads to a reduction of the energy required per throughput quantity of fibers.

All these effects collectively lead to a substantial improvement in the productivity of the individual carding machines.

While there are shown and described present preferred embodiments of the invention, it is distinctly to be understood the invention is not limited thereto, but may be otherwise variously embodied and practiced within the scope of the following claims.

We claim:

1. A carding machine comprising:

at least one carding cylinder having a substantially cylindrical surface, the carding cylinder having a diameter which amounts to between 400 mm and 600 mm;

clothing provided for the cylindrical surface of the carding cylinder and defining a predetermined working width of the carding machine;

a feeding system for substantially uniformly feeding the carding cylinder with fibers to be processed over the entire predetermined working width;

a revolving flat arrangement for the substantially uniform carding of fibers on the carding cylinder over the entire predetermined working width;

a doffing system for the collection of carded fibers over the entire predetermined working width; and the predetermined working width amounts to less than 800 mm.

2. The carding machine according to claim 1, wherein:

said at least one carding cylinder constitutes a sole carding cylinder; and the feeding system works directly together with the sole carding cylinder.

3. The carding machine according to claim 1, wherein:

said at least one carding cylinder constitutes a sole carding cylinder; and the doffing system works directly together with the sole carding cylinder.

4. The carding machine according to claim 1, wherein:

said at least one carding cylinder constitutes a sole carding cylinder; and the feeding system and the doffing system work directly together with the sole carding cylinder.

5. The carding machine according to claim 1, wherein:

the predetermined working width amounts to between 400 mm. and 600 mm.

6. The carding machine according to claim 1, wherein:

the feeding system comprises a licker-in which has a diameter which amounts to between 90 mm. and 150 mm.

7. The carding machine according to claim 1, wherein:

the doffer system comprises a doffer roll which has a diameter which amounts to between 200 mm. and 300 mm.

8. The carding machine according to claim 1, wherein:

the carding cylinder comprises a steel carding cylinder.

9. The carding machine according to claim 1, wherein:

the feeding system comprises a licker-in;

the doffer system comprises a doffer; and integral side walls for supporting the carding cylinder, doffer and licker-in.

10. The carding machine according to claim 1, further including:

frame means cooperating with the carding cylinder;

play-free bearing means provided for said frame means; and said carding cylinder being carried by said play-free bearing means at said frame means.

11. The carding machine according to claim 1, wherein:

said clothing comprises at least one carrier and points carried by said at least one carrier.

12. The carding machine according to claim 11, wherein:

the points comprise needles.

13. The carding machine according to claim 11, wherein:

said at least one carrier comprises a rod extending over the entire predetermined working width.

* * * * *